US006082931A

United States Patent [19]

Hopper

[11] Patent Number: 6,082,931

[45] Date of Patent: Jul. 4, 2000

[54] MODULAR MARITIME DOCK DESIGN

[75] Inventor: Mark A. Hopper, San Francisco, Calif.

[73] Assignee: ValueQuest, Inc., San Francisco, Calif.

[21] Appl. No.: 09/102,596

[22] Filed: Jun. 22, 1998

Related U.S. Application Data

[60] Provisional application No. 60/082,536, Apr. 20, 1998.

[51] Int. Cl.[7] ..... E02D 23/02; E02D 23/16; E02D 5/54

[52] U.S. Cl. ..... 405/218; 405/205; 405/210; 405/224; 114/256

[58] Field of Search ..... 405/203, 204, 405/205, 207, 208, 210, 218, 219, 224, 258, 259.1, 262; 114/256–258; 249/1, 188, 207

[56] References Cited

U.S. PATENT DOCUMENTS

| | | | |
|---|---|---|---|
| 1,900,319 | 3/1933 | Vermeulen | 405/218 |
| 2,747,840 | 5/1956 | Miles | 175/9 |
| 2,945,465 | 7/1960 | Barton | 114/256 |
| 3,022,759 | 2/1962 | McCall | 114/266 |
| 3,091,203 | 5/1963 | Usab | 114/266 |
| 3,131,542 | 5/1964 | Koch | 405/219 |
| 3,426,109 | 2/1969 | Dempster | 264/34 |
| 3,464,212 | 9/1969 | Yamagata et al. | 405/204 |
| 3,492,825 | 2/1970 | Pearson | 405/219 |
| 3,691,974 | 9/1972 | Seiford et al. | 114/0.5 F |
| 3,938,341 | 2/1976 | Prins | 405/210 |
| 3,999,879 | 12/1976 | Stachiw et al. | 404/73 |
| 4,080,793 | 3/1978 | Pulsifer | 405/29 |
| 4,106,303 | 8/1978 | Shimada et al. | 405/63 |
| 4,223,629 | 9/1980 | Dunlop | 114/263 |
| 4,355,431 | 10/1982 | Diefendahl et al. | 14/27 |
| 4,642,000 | 2/1987 | Lin | 405/221 |
| 4,645,379 | 2/1987 | Grimsley et al. | 405/210 |
| 4,653,240 | 3/1987 | Jenn | 52/169.2 |
| 4,660,495 | 4/1987 | Thompson | 114/263 |
| 4,683,833 | 8/1987 | Meriwether | 114/267 |
| 4,726,316 | 2/1988 | Bruns | 114/263 |
| 4,928,617 | 5/1990 | Meriwether | 114/267 |
| 4,938,629 | 7/1990 | Boudrias | 405/205 |
| 5,090,884 | 2/1992 | Beaman | 425/63 |
| 5,199,371 | 4/1993 | Meriwether | 114/267 |
| 5,213,447 | 5/1993 | Srock | 405/219 |
| 5,257,593 | 11/1993 | van den Elshout et al. | 114/263 |
| 5,281,055 | 1/1994 | Neitzke et al. | 405/219 |
| 5,282,435 | 2/1994 | Chapman | 114/263 |
| 5,347,948 | 9/1994 | Rytand | 114/263 |
| 5,354,151 | 10/1994 | Giannesini | 405/205 |
| 5,364,206 | 11/1994 | Marienfeld | 405/16 |
| 5,375,550 | 12/1994 | Innis | 114/267 |
| 5,417,523 | 5/1995 | Scales | 405/284 |
| 5,649,787 | 7/1997 | Hirose et al. | 405/219 |
| 5,823,714 | 10/1998 | Chattey | 405/204 |

OTHER PUBLICATIONS

H. Ligteringen, et al., "Innovative Terminal Concepts for Container and Bulk Cargo Handling and Storage," Mar. 8–11, 1998, Long Beach, California, vol. 2, pp. 152–161, *American Society of Civil Engineers*.

T. Thaler, "Sailing the Seas with 5,400–tonne Caissons," Mar. 1990, pp. 20–21 (w/5 pages of project descriptions), *Construction Record*.

Schematic of proposed Indian maritime project.

*Primary Examiner*—Eileen Dunn Lillis
*Assistant Examiner*—Tara L. Mayo
*Attorney, Agent, or Firm*—Beyer Weaver & Thomas, LLP

[57] ABSTRACT

A maritime dock structure including a plurality of hollow modules each having a buoyancy force associated therewith. A plurality of anchors are coupled to the modules and embedded in an underwater bed. Each anchor opposes the buoyancy force of its associated module as well as lateral forces and load forces directed into the underwater bed.

78 Claims, 20 Drawing Sheets

MODULAR MARITIME DOCK DESIGN

RELATED APPLICATION DATA

This application is a nonprovisional application claiming priority from U.S. Provisional Application Ser. No. 60/082,536 for MODULAR MARITIME DOCK DESIGN filed on Apr. 20, 1998, the entire specification of which is incorporate herein by reference for all purposes.

BACKGROUND OF THE INVENTION

The present invention relates to the art of docks and related structures which are used to store and transfer goods and equipment, especially cargoes, between the land and a vessel in the water.

Waterfront land is expensive, usually because it is unavailable in sufficient quantity where needed. Where land is available there are often competing "higher and better uses". Some ports must resort to filling portions of the bodies of adjacent water to create land. These alternatives are pursued at great expense and environmental impact.

Many necessary waterfront activities are inherently land intensive. In cargo handling activities, shipping containers are often parked on paved land surfaces while still mounted on a highway worthy chassis. Such container storage areas must also include vehicle circulation areas for maneuvering the units around the parking spaces and for moving them between the parking spaces and the dock. At the dock the containers are transferred to or from a vessel. Similarly, bulk cargoes such as coal and wood chips are often stored in stacks on the land surfaces behind the dock. These stacks expand horizontally with the addition of more materials, occupying disproportionately large areas of land for the volume of material stored. Other dry bulk, liquid bulk, and break bulk cargoes are stored in warehouses or tank farms behind the docks. These warehouses and tanks not only occupy significant backlands, they are also expensive to build and maintain. In urban areas even non-cargo operations such as hotels, sports complexes, etc., generate the need for parking and warehousing operations that occupy large waterfront land areas. The present dock invention is intended to consolidate and intensify these types of activities inside, on and near the dock, thereby reducing the need for waterfront land to be used as storage areas.

Some warehousing and storage facilities on the waterfront include the means for refrigerating their cargo contents. This capability is provided at a high initial cost of refrigeration equipment and insulation materials. It also entails high operational and maintenance costs, especially in warmer climates. The present dock invention is intended to incorporate the means to greatly mitigate these initial and ongoing costs of conventional refrigerated storage, harnessing the predictably lower temperature of the body of water adjacent to many dock locations in the refrigerating effort. The storage strategy of the present dock invention also takes advantage of the fundamental tendency of warmer air to rise and cooler air to fall.

When the congestion of competing activities near the waterfront force land intensive activities to expand away from the water's edge, farther into the backlands, increased operational expenses are incurred. Shipping containers stored away from the waterfront must be drayed between storage and the dock for a vessel loading or unloading operation. Sometimes this drayage must include the use of public thoroughfares, thus making an already troublesome urban traffic problem even worse. When bulk cargo materials are stored away from the water's edge, expensive conveyors are often installed to facilitate the transfer of these cargoes between storage and the vessel during loading and unloading operations. The maintenance and cleaning of these conveying systems is troublesome and expensive. Moreover, different bulk materials have different handling characteristics and their conveying systems must sometimes be optimized for a few types of materials at the expense of efficient handling of others. This multiplicity of cargo characteristics, the related infrastructure and equipment needs and the cargo handling techniques for each cargo type are all reasons why it is difficult to use a single dock for several cargo types, either at the same time or in sequence. The present dock invention is intended to simplify the operational implications of moving a wide variety of cargoes between storage and the vessel by creating significantly more storage at the waterfront than is currently available. It will also eliminate the need for much of the equipment and labor traditionally employed in the transfer between storage and the vessel, thereby eliminating many of the traditional conflicts inherent in handling a variety of cargoes at a single dock. Similarly, this invention is intended to consolidate other non-cargo parking and warehousing functions on the waterfront.

Even where conventional storage facilities are already conveniently located near the dock, the actual transfer between storage and the vessel is often a frenzied operation which involves intense concentrations of labor and equipment. The present dock invention is intended to improve this transfer operation by eliminating some of the presently necessary activities along with their related labor and equipment.

Oftentimes, cargo storage facilities on the waterfront are either inadequate or inefficient and cause awkward and expensive vessel loading and unloading operations. This is inherent in some dry bulk operations which perform indirect cargo transfers between a train and a vessel to obviate the need for waterfront storage facilities. In a typical instance the arrival of a mile long "unit train" is synchronized with the arrival of a large bulk carrier vessel. The bulk product is then dumped from the train into a pit, reclaimed to a conveyor, conveyed to the dock, and piped through a loading arm, into the vessel hold. Such an operation, and the cleanup in its aftermath, is labor and equipment intensive. Further, sometimes the movements of the vessel and the train cannot be adequately coordinated and large unintended demurrage costs are encountered by one or both. The present dock invention is intended to weaken or sever the link between the arrival of the train and the arrival of the vessel and, at the same time, reduce the labor and equipment intensity needed for this type of cargo transfer operation.

As shown in FIG. 1, most modern docks (e.g., dock 100) incorporate a rigid horizontal platform 102, usually supported by piles 104, across which cargoes can be efficiently transferred between land and vessel. This platform is usually designed to support its own weight, the weight of a modest amount of staged cargo and the weight of the vehicles and handling equipment needed to effect the cargo transfer to and from the vessel. Such a dock system usually also includes a means for stabilizing the earth at the water's edge. As illustrated in FIG. 2, the earth's slope behind the dock is often comparatively unstable in its normal state and would be made more unstable if cargo and equipment loads 202 were to be superimposed on its surface. There would be a strong tendency for the earth to undergo the classic, possibly catastrophic, slip failure (represented by slip circle 204) under these superimposed loads. Such an earth failure could cause massive amounts of earth to slide into the water carrying the dock and related cargo and equipment with it (reminiscent of the classic landslide on shore). Consequently, the earth's slope stability at the water's edge must often be enhanced by installing a retaining wall structure 106. Sometimes the earth pressures behind this retaining wall are mitigated by installing a pile supported relieving platform 108 to carry some of the weight of the earth and the superimposed loads down deeper into the soils. At other times the pile supported platform is built wider over a long and gradual slope of the bank, which has been armor protected with rock to retain its stability. All of these structural techniques come at high cost for the utility of transferring cargoes between the land and the vessel. The present invention is intended to provide both the rigid transfer platform and the means of enhancing the earth's stability in a different form that also provides the storage consolidation and cargo handling improvements promised above.

Modern docks are also constructed using caissons. These caissons are concrete boxes which are fabricated hollow so that they can be floated into position. When positioned, they are ballasted until they sink and come to rest on a previously prepared bottom. Subsequently, the boxes are filled to the top with ballast such as rock and a top lid of concrete is poured to form the rigid cargo transfer platform of a dock. These filled concrete boxes then serve as a gravity dam or gravity retaining wall as land is filled in behind them to create the smooth transition to the shore which is needed for cargo handling. The land fill is usually paved for cargo loads. In this approach to dock construction, the concrete boxes (caissons) replace both the rigid pile supported cargo transfer platform and the earth slope stability enhancements of the more conventional dock approach.

Floating docks have also been used as rigid cargo transfer platforms, both with and without accompanying earth stability enhancing structures. These floating docks resemble a barge or pontoon assembly and they employ only the water's buoyant forces to support the dock, cargo and equipment loads where more conventional dock designs transfer these loads to the soils below. The present dock invention massively increases the cargo stored on and in the dock, proportionally increasing the total loads of the dock and its contents. Its design harnesses very large buoyant forces (well beyond those previously employed in the floating dock design art) and, at the same time, it employs soil bearing pressures and earth anchors to carry the significantly increased earth, dock, cargo and equipment loads.

One of the greatest advantages of a traditional floating dock concept is the ability to fabricate the dock at a preferred location, remote from the location of intended use, and then tow the nearly complete assembly into place using conventional maritime transportation techniques. In fact, one can conceive of actually relocating a floating dock from an initial working location to another working location if the needs change. In the context of military operations, the ability to relocate a dock structure to the forward areas of a contingency operation creates powerful logistics advantages. During World War II, the American forces employed a "DeLong Pier" to great advantage. This was a steel barge/pontoon which was floated and towed across the water into the remote place of need. The barge was then jacked into the air on spud piles which were threaded through spud wells fabricated into the deck of the barge. The jacked up barge then became a rigid cargo transfer platform resembling a conventional dock and the spud piles transferred all loads into the soils below. The present dock invention extends, expands and alters the concept embodied in the DeLong Pier. The present dock can be fabricated off site, ballasted to stability and towed to a site for final installation. Unlike the DeLong and other traditional floating docks, the present dock invention is then further ballasted to lower (instead of raise) it into its final position where it is then anchored to the soil sufficiently to mechanically overcome the net positive buoyant force that will be present when the cells are emptied of ballast and made ready to receive cargoes for storage. The present dock invention is then emptied of ballast and the hollow cells are used for cargo storage. Later, the dock cells can be reballasted to overcome net positive buoyant forces, disconnected from their earth anchorage, reballasted for towing stability and then towed to a new location installation. The reballasting for towing stability during transport can include the loading of actual cargoes to facilitate a military operations in the forward areas. Thus, the present dock invention can serve as a cargo carrier when it is in transit. It will then serve as a highly efficient dock when installed at the battlefront and all of its initial cargo has been off loaded.

In many cases existing conventional docks are reaching the end of their useful life span for one or more reasons which will be discussed with reference to FIG. 3. One common reason for the diminishing utility of a conventional dock is that it was not designed for the dredge depth that is currently needed by modern ships. Another is that it was not designed for gantry or other crane loads that are currently needed by modern cargo handling techniques. Yet another is that such a dock has insufficient apron width 302 for modern cargo handling operations. In addition, such a dock might incorporate a sheetpile wall earth retaining structure 304 or an armor coated bank slope 306 which is progressively failing and is prohibitively expensive to repair or replace. Finally, such a dock may have insufficient cargo storage capacity in the backlands and no additional land is available. The present dock invention concept is intended to be applied to the rehabilitation of existing conventional docks to solve any or all of the deficiencies listed above and to prolong their remaining useful life. Further, after the present dock invention concepts have been applied to prolong the life of a distressed existing conventional dock, it will then be possible to convert the distressed dock into a thoroughly new dock with a minimum of additional cost once the old parts of the structure are no longer serviceable.

SUMMARY OF THE INVENTION

In accordance with the present invention, a dock consists of one or more watertight modular hollow cell structures, which generally take the shape of a six sided box. Both the construction material of the cell and the cell's dimensions are optimized for the type and quantity of cargoes anticipated and the resulting buoyant and other forces anticipated in the dock's operations. The cells are assembled in rows across the waterfront face to form the dock. Additional rows of cells, as needed for additional cargo storage capacity, are assembled in parallel to the first row.

When positioned at the installation site, the cells will be individually or collectively ballasted until they have sunk to the desired installation depth. According to specific embodiments, the bottom of the cells will be in uniform contact with the previously prepared soils beneath. Also according to specific embodiments, the strength of the soils beneath will have been augmented as necessary with selected engineering materials and soil consolidation techniques and the bottom's surface will have been smoothed for uniform contact with the cell bottoms. The cells will then be anchored in place by a suitable form of earth anchor installed at locations and angles which most efficiently resist the anticipated maximum forces on the cells when they are empty. Either landfill will be placed behind the row(s) of cells or access ramps will be built to connect the cells to the shore.

After anchorage is complete, the cells will be emptied of ballast and used for the storage and handling of cargoes and other non-cargo goods and equipment. The limit of the cargo and other loads which can be accepted by the new dock system will be the sum of the net positive buoyant force acting on the cell(s) when empty and the limit of the weight bearing capacity of the engineered soils in contact with the bottom of the cell(s).

In special circumstances where the sum of the net positive buoyant force on the empty cell plus the maximum achievable bearing capacity on the engineered soils in contact with the bottom of the cells is insufficient, piles may be added to the load bearing system to carry any excess loads.

There are other special circumstances where the envisioned dock may be installed in very deep water or in locations where there are soil materials below the cells that are so soft that they do not successfully resist any pressures that the cell bottoms attempt to transmit to them. In these installations additional net positive buoyant forces may be created by increasing the height dimension of the cells either to displace more water or to displace the soft "muds" on the bottom.

The present dock invention also includes an installation of several rows of cells assembled roughly in the fashion of an island, anchored in a near shore location in deep water, loading and unloading vessels too large to call the ports along the adjacent shoreline. Such an embodiment of the invention may or may not have cells penetrating the bottom of the body of water, depending on the site needs. The island of cells may have some individual cells displacing bottom soil materials and some others simply displacing water where the water is deeper. The cargoes that these large ships load and unload at such a cellular island dock will then be shuttled by smaller vessels to and from the shore. Such an island dock constructed of storage cells according to this invention may also be connected to the shore by floating access ramps for truck and rail access. These access ramps would be constructed according to the current state of the floating causeway art.

When a new dock is built or an old dock is rehabilitated using the present dock invention concepts, cargoes may be stored in the cells in deep recesses above, at and below the water's surface. This will create the need for mechanical systems and devices which are capable of moving, especially lifting, the cargoes from the cells to the upper transfer platform of the dock. One such device, which is a natural extension of the basic concept of this invention, harnesses the natural water pressure at the bottom of the cell to move an hydraulic cylinder which performs the work of lifting cargoes to the top of the cell.

The present dock invention is a hybrid system which massively increases the storage capacity of known docks. The storage capacity increase not only replaces precious waterfront land, it also significantly reduces the labor, equipment and time needed to handle cargoes compared to present methods.

Thus, the present invention provides a maritime dock structure comprising a plurality of hollow modules each having a buoyancy force associated therewith. A plurality of anchors are coupled to the modules and embedded in an underwater bed. Each anchor opposes the buoyancy force of its associated module as well as lateral forces and load forces directed into the underwater bed.

A further understanding of the nature and advantages of the present invention may be realized by reference to the remaining portions of the specification and the drawings.

DESCRIPTION OF SPECIFIC EMBODIMENTS

Figure 1:
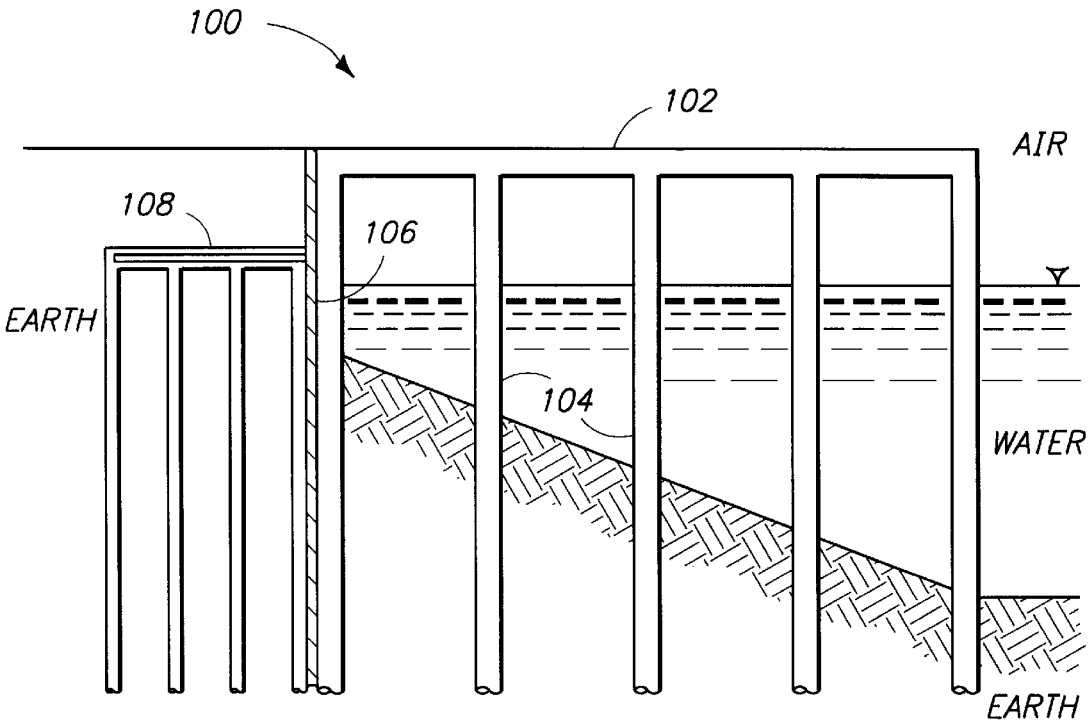
FIG. 1 is a cross section drawing of a typical conventional modern dock.
Figure 2:
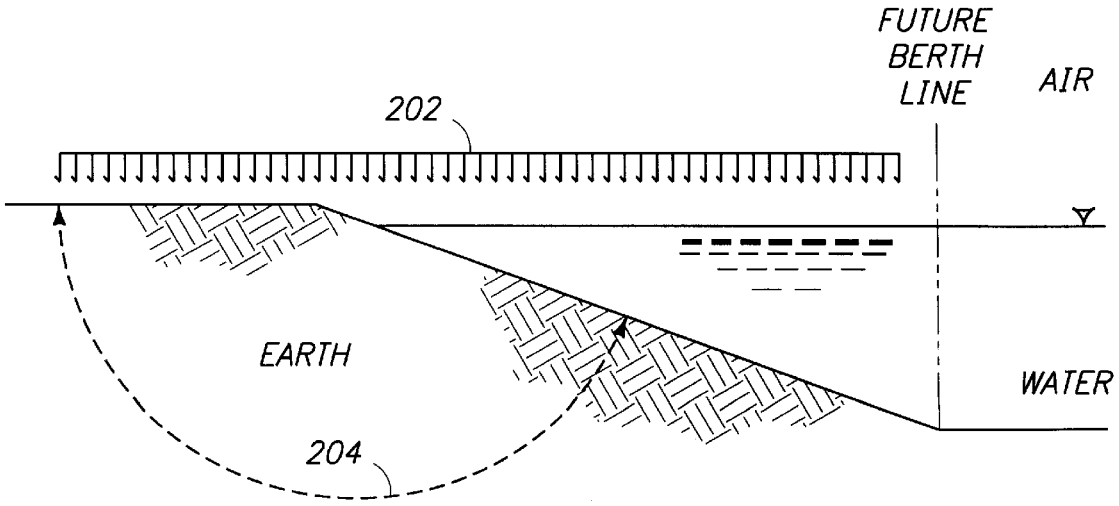
FIG. 2 is a cross section drawing of a typical earth failure slip circle which must be resisted in most typical waterfront locations.
Figure 3:
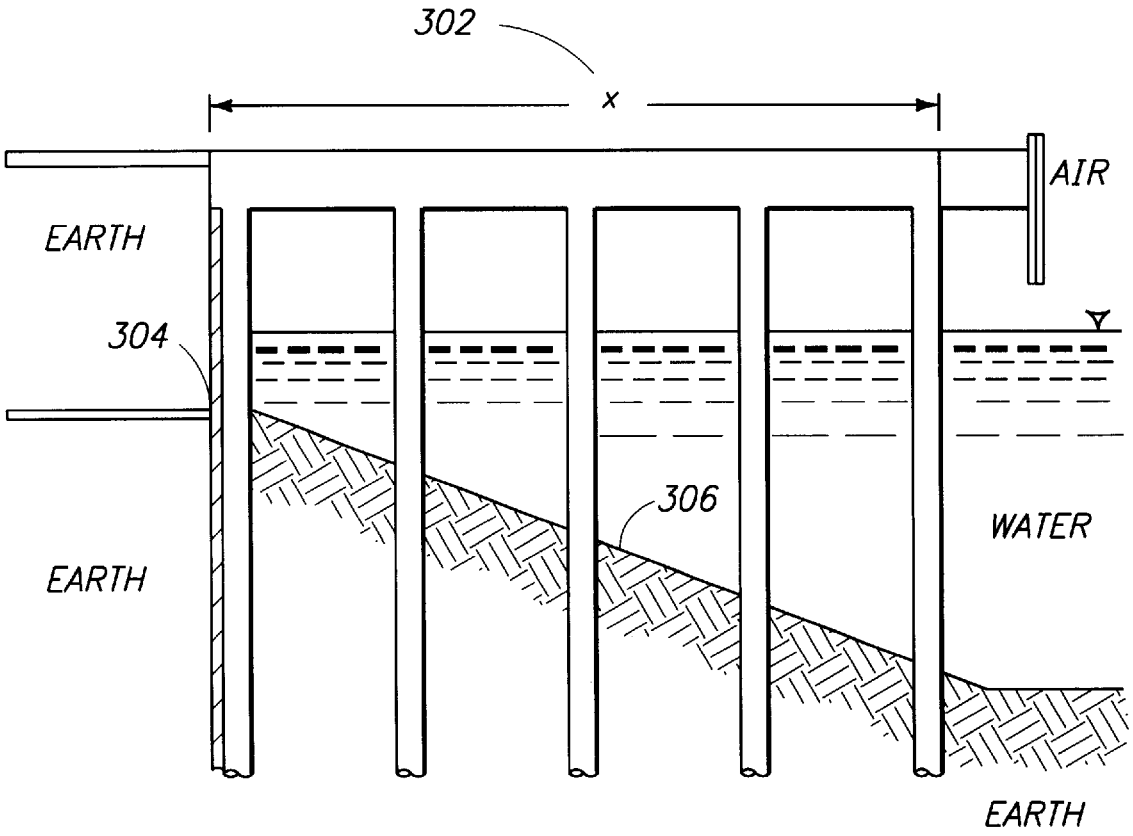
FIG. 3 is a cross section drawing of an older style typical dock illustrating the operations and maintenance problems that typically make these docks unserviceable.
Figure 4:
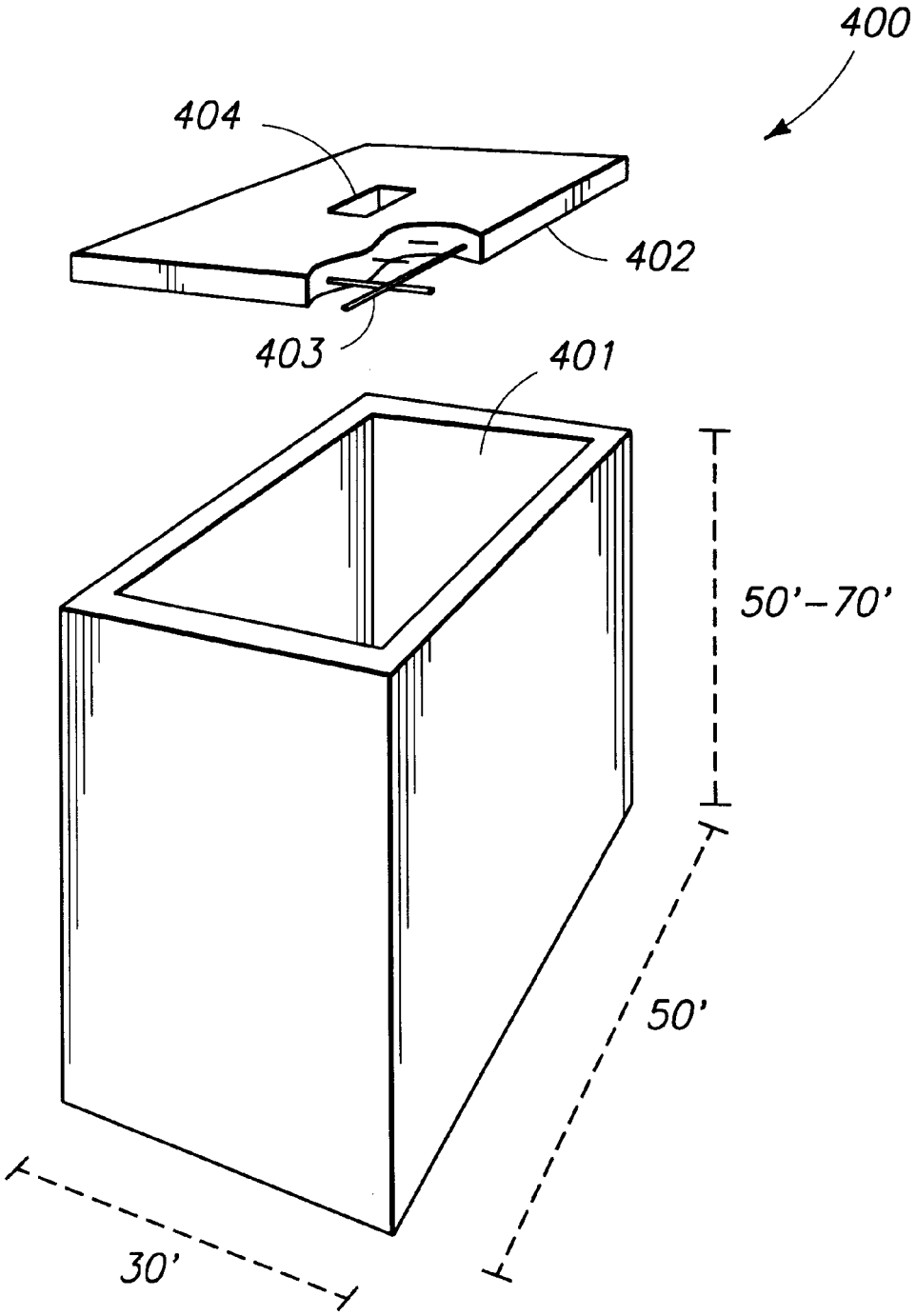
FIG. 4 is an isometric drawing of the typical watertight modular hollow cell structure which is the basic building block of the current dock invention.
Figure 5:
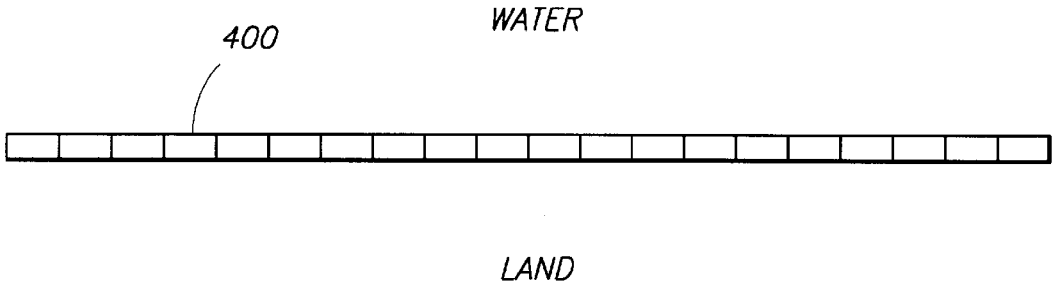
FIG. 5 is a plan view drawing of a row of linked cells shown in FIG. 4 which form the basis of a the typical cargo handling dock envisioned by this invention.

A specific embodiment of the present invention is shown in FIGS. 4, 5, 6 and 7. The individual modular hollow cell structure 400 in FIG. 4 is the basic building block of the present dock invention. In the most simplistic case, the dock could consist of a single cell. Typically, it will consist of more than one cell. As discussed above, a wide variety of cargo types may be stored in the interior volume 401 of cell 400. According to some embodiments, the top 402 of cell 400 is removable to provide access to the interior of the cell. According to other embodiments, top 402 is permanently fixed to the cell and access to the interior is provided via a hatch opening 404. The interior of each cell is constructed to prevent the corruption of stored cargoes from, for example, moisture or atmospheric contaminants. According to a specific embodiment, the interior of the cell is lined with a high molecular weight plastic. According to another embodiment, the cell incorporates some form of insulation and/or temperature control system to facilitate the storage of perishable or temperature sensitive goods. The cost of refrigeration would be greatly reduced in such an embodiment in view of the fact that the water outside of the cell would act naturally to cool its interior.

Both the construction material of the cell and the cell's dimensions are optimized for the type and quantity of cargoes anticipated and the resulting buoyant and other forces anticipated in the dock's operations. According to a specific embodiment of the invention, the cells are constructed of concrete reinforced with steel 403, though other materials may be more appropriate in special conditions. FIG. 4 shows some exemplary cell dimensions. According to various embodiments of the invention, any or all of these dimensions may vary and can be optimized for a particular installation site and suite of anticipated cargoes. If, for example, the dock is expected to handle conventional cargo shipping containers, then the interior dimensions of the cells may be multiples of the dimensions of the standard shipping container (plus additional interior space for cell guides, etc.). FIG. 4 shows a cell planned for about three columns of standard containers which could have six to eight units in each column. The height chosen for each cell will also depend on the depth of the water desired at the dock vessel berth and the related earth slope stability enhancement needed by the soils at the installation site. Both earth slope stability and cell storage capacity will be increased as the cell height is increased. Cell height increases will be achieved at added cost and increasing difficulty in installation. A cost-benefit analysis will be called for at each installation site for a given range of cargo characteristics and soil conditions.

Figure 6:
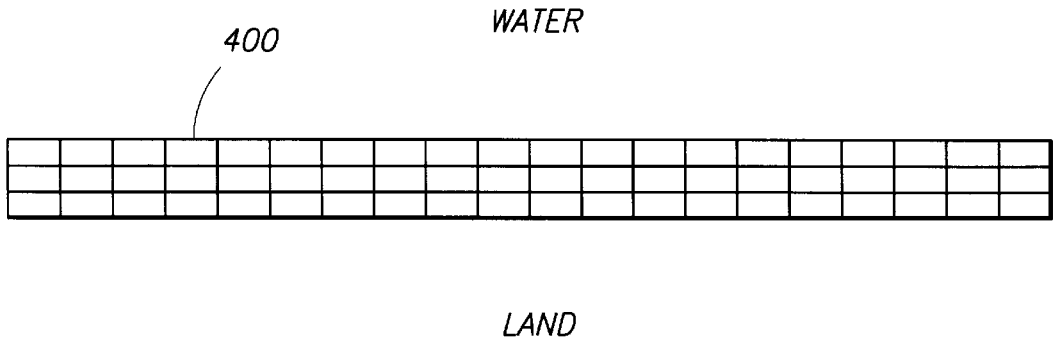
FIG. 6 is a plan view drawing showing several rows of linked cells which will be typical for the cargo handling dock envisioned by this invention that goes beyond the minimum adequate dock and incorporates additional cells, primarily for their additional cargo storage and handling capacity.

The number of individual cells comprising a complete dock will depend on the length of vessels which are to be berthed at the dock and the amount of cargo one desires to store inside the cells. Currently, individual container cargo berths are typically planned for up to 1300 feet of berth length. Much shorter berth lengths are sometimes entirely appropriate for other cargoes and vessels. Although one row of cells 400 across the face of a dock can be sufficient to create the dock of desired length and to provide the earth slope stability enhancement needed by the site (FIG. 5), additional rows of cells 400 will create significantly more storage capacity on the waterfront and will enhance earth slope stability even further (FIG. 6). Consequently, the selection of any additional row of cells beyond the site minimum will be guided by a cost benefit analysis of the added cargo storage and handling efficiencies versus the added cost. Local costs of waterfront land, labor and equipment will govern this decision.

Figure 7A:
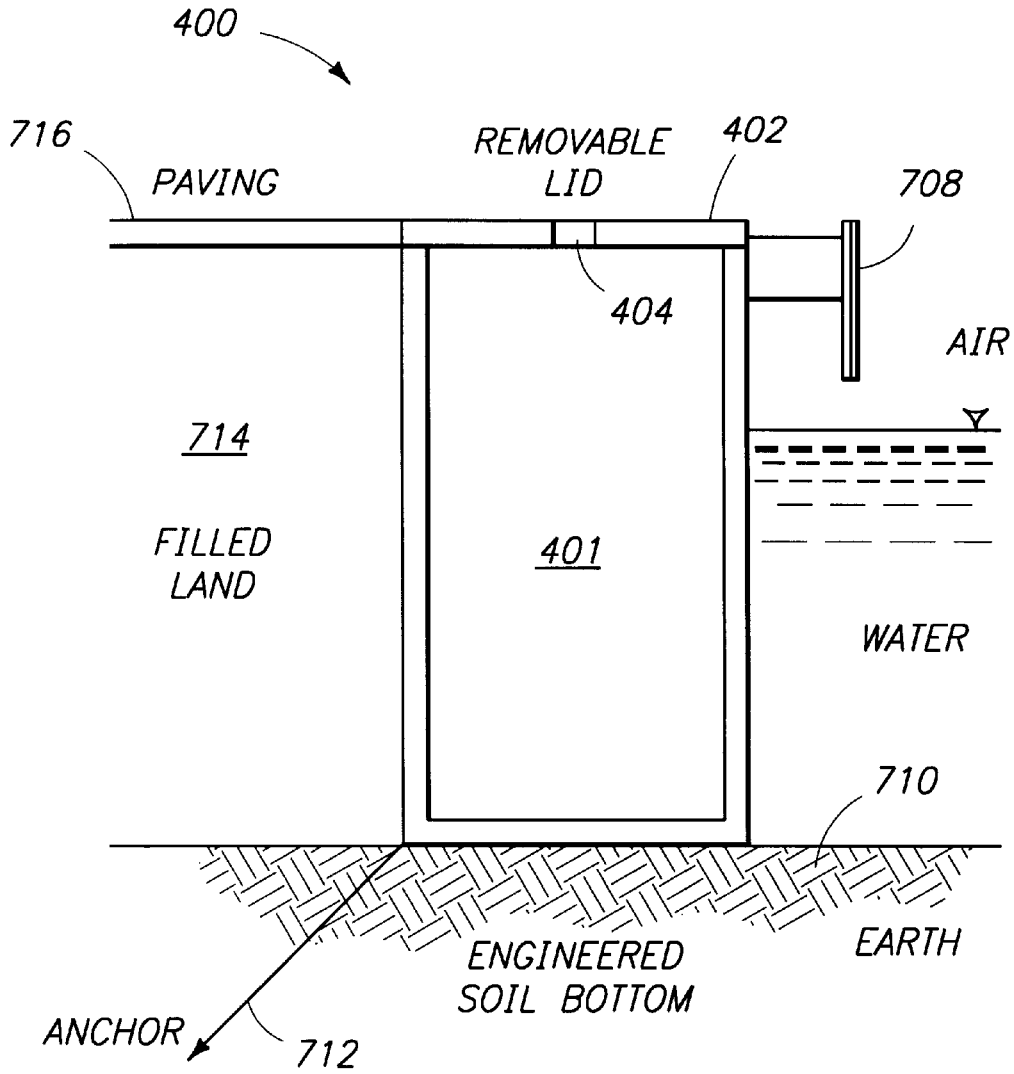
FIGS. 7A–7D are cross section drawings of the present dock invention according to various specific embodiments.

FIG. 7A is a cross section drawing of an installed dock cell 400 according to a specific embodiment of the present invention. Dock cell 400 has an interior volume 401 in which a wide variety of cargo types may be stored. Access to the storage area is achieved through removable lid 402. In one embodiment, a hatch 404 is provided in lid 402 to provide an alternate means of accessing the storage area. A bumper 708 is provided to at least partially absorb lateral forces from docked vessels. As shown in FIG. 7A, cell 400 is in contact with an engineered soil surface 710 and its position is fixed with an earth anchor 712. The area adjacent cell 400 is filled with landfill 714 having a paved surface 716 thereon which provides a working area which is flush with the top of lid 402.

Figure 7B:
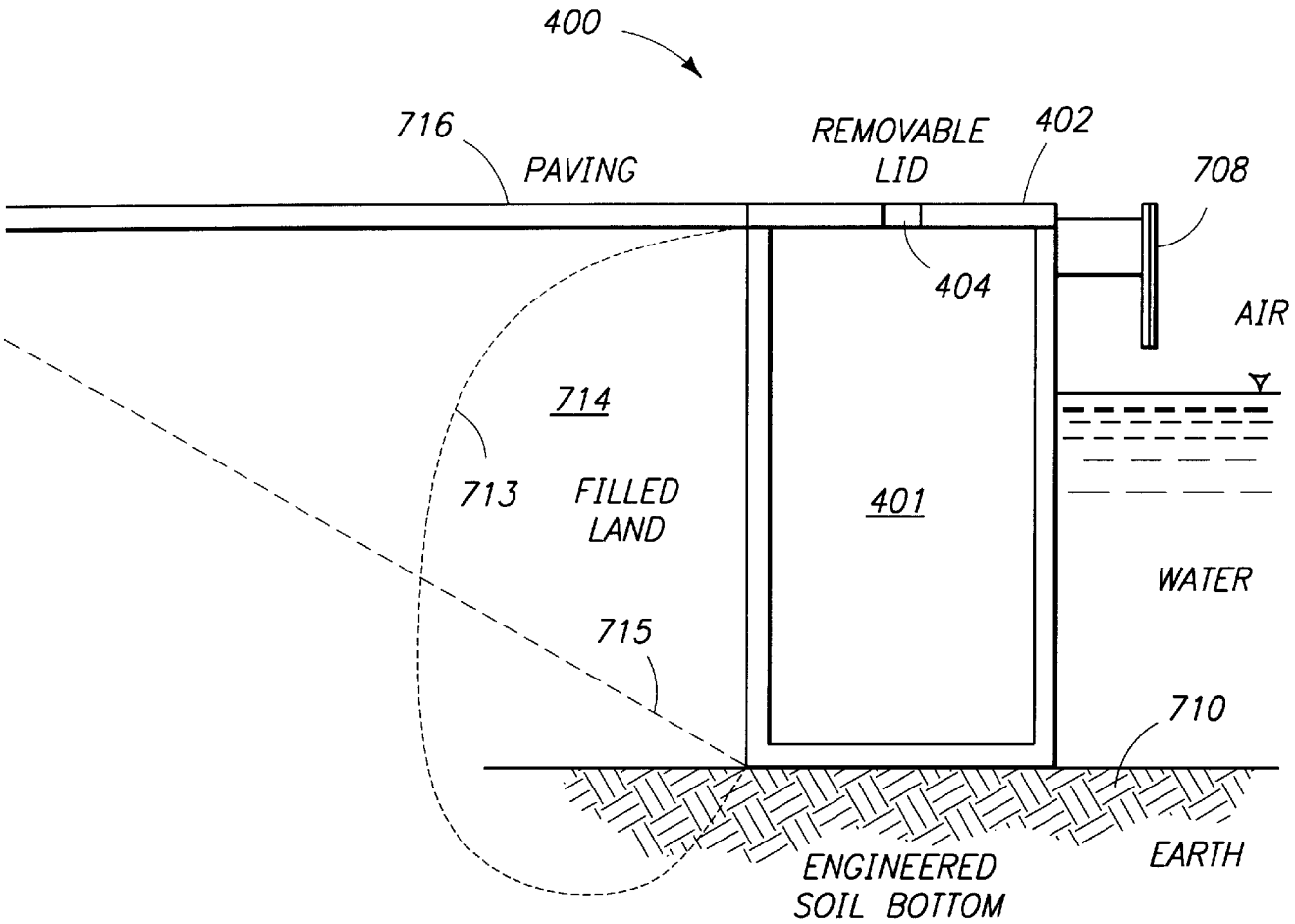

As discussed, anchor 712 in the embodiment of FIG. 7A resists the buoyancy force of cell 400 as well as other lateral and load forces. According to various embodiments, anchor 712 may be implemented in a variety of ways. For example, anchor 712 may comprise one or more piles, drilled earth anchors, or even traditional sea anchors. FIG. 7B shows yet another method of anchoring cell 400 which makes greater use of soil pressures in the engineered surface 710 and landfill 714 which are installed after altering the original shore slope 715. In this embodiment, a flexible material or netting 713 (shown in cross section) is secured to the lower corner of cell 400 as shown. Netting 713, which may be made of steel or some other heavy duty material, extends downward and away from cell 400 in a manner similar to anchor 712 thereby opposing the buoyancy force associated with cell 400 as well as lateral forces exerted by the mass and movement of landfill 714. In addition, netting 713 may extend an appropriate distance toward land, be covered with fill and then doubled back on the fill as shown and secured at or near the top of cell 400. The netting is then covered with the additional fill. The result is an enhancement to the cell's ability to withstand lateral forces which would cause it to fall over into the water. That is, the pressure exerted by the soils on the surface area of netting 713 provides additional resistance to any tendency of cell 400 to topple over or slide toward the water as a result of lateral soil pressures on the cell 400.

Figure 7C:
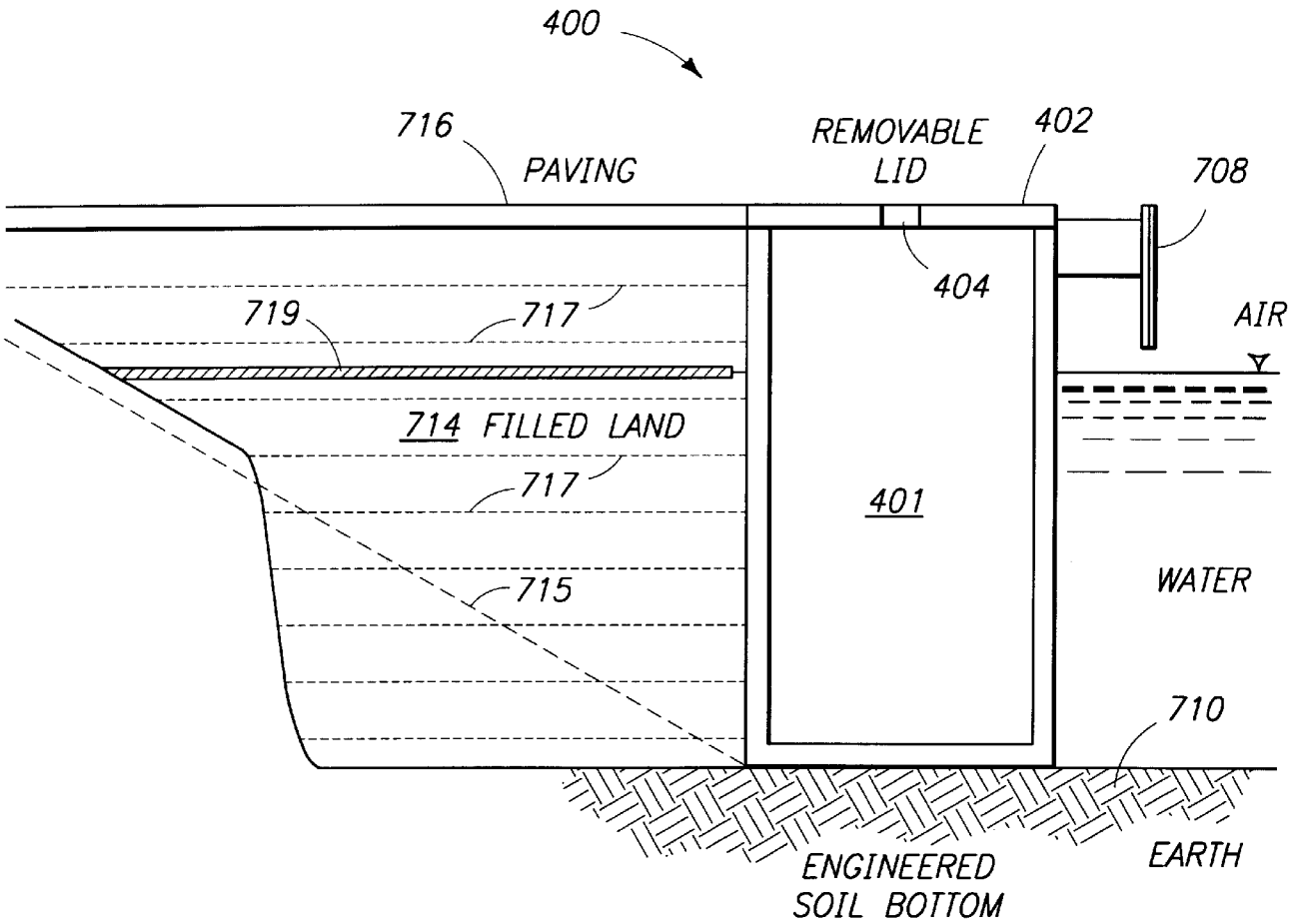

FIG. 7C shows another specific embodiment of an anchoring system. Here, a plurality of netting layers 717 are attached to cell 400 at intervals with each being covered by a layer of compacted earth fill. Some types of material for netting 717 and 713 are already known and used in the civil engineering community, especially in highway bridge abutment and retaining wall construction, and are commonly referred to as "geotextile matting". According to a specific embodiment of the invention, netting 713 and/or 717 comprises a web of used vehicle tires interconnected by, for example, steel chains or cables as shown in FIG. 7E. This is an attractive solution for a couple of reasons. Firstly, vehicle tires comprise an extremely strong material which is highly resistant to deterioration. Secondly, this solution provides an opportunity to recycle a few thousand tires. Anyone who has ever wondered what will be done with the many huge piles of used tires along the sides of many of our highways will understand the desirability of this application. According to another embodiment, a fabricated slab of, for example, concrete or steel 719 as shown in FIGS. 7C and 7F, is embedded in the underwater bed and coupled to the cell as the anchor. The soil pressure exerted on the surface area of the slab provides resistance to the various forces exerted on the cell.

Figure 7D:
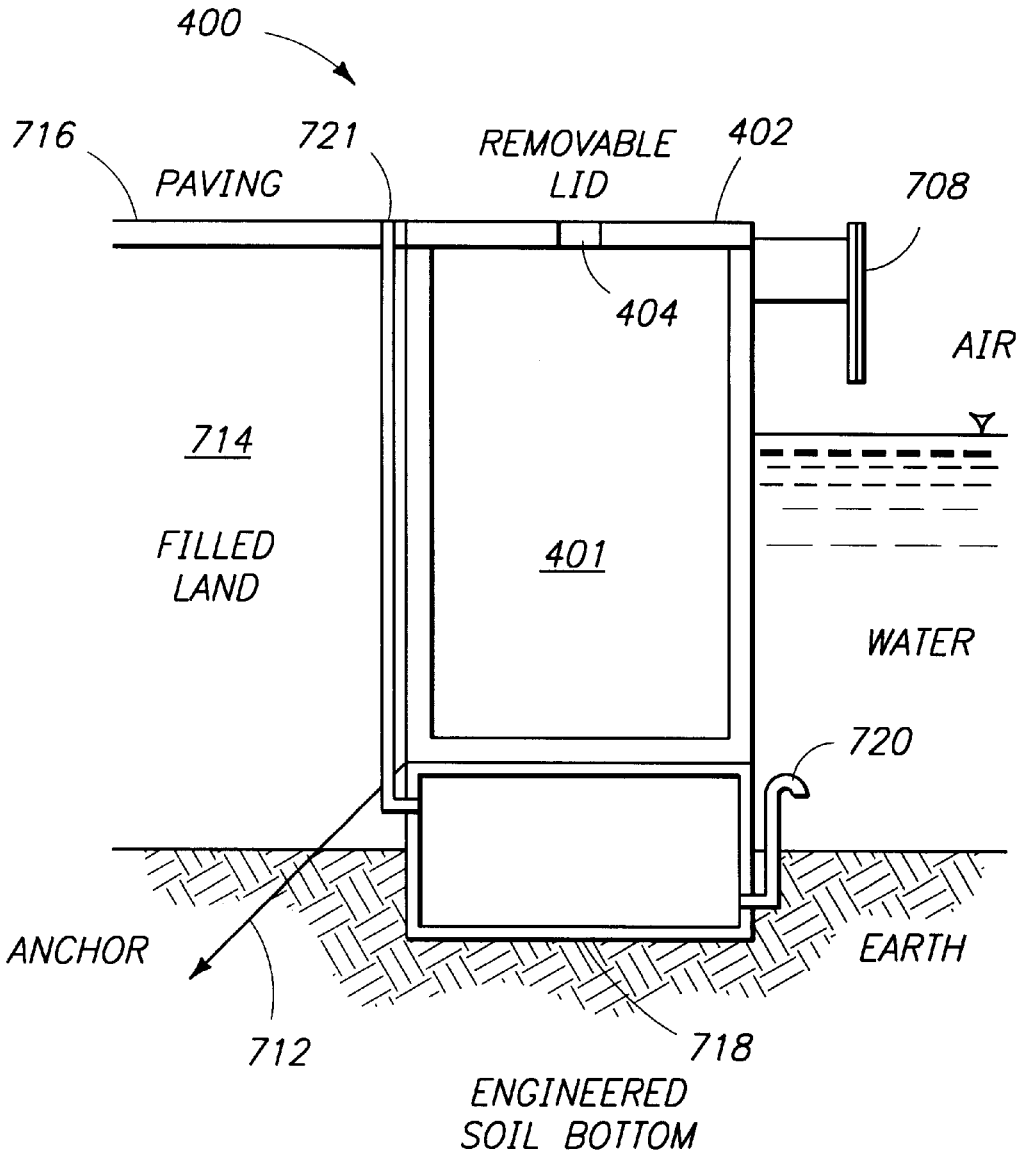
Figure 7F:
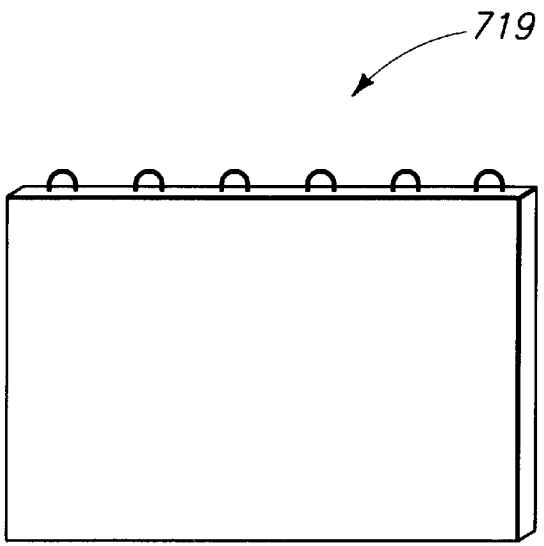
FIGS. 7E and 7F show specific embodiments of representative anchor materials.
Figure 7E:
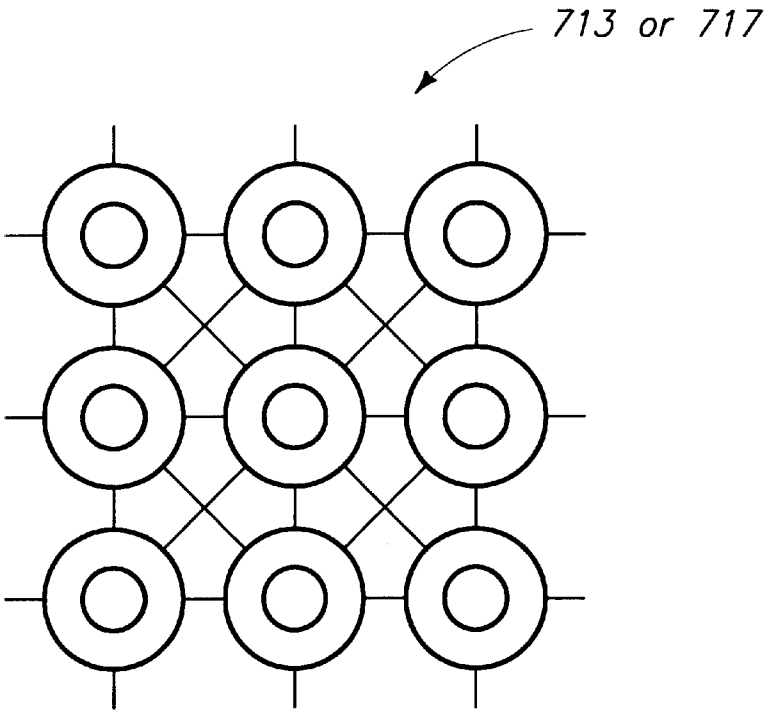

FIG. 7D shows a specific embodiment of the invention which may be useful with exceptionally heavy cargo or soft bottom materials. A secondary ballast/buoyancy cell 718 is fitted under basic cargo cell 400. Cell 718 is both water tight and air tight and is employed to provide extra buoyancy or ballast on demand to fit the needs of the changing loads on the basic cargo cell 400. Cell 718 is provided with an opening to the pressurized sea water on the bottom via a pipe 720. Access to this pressurized sea water is controlled by an operable valve (not shown) in pipe 720. Cell 718 is also provided with an opening on the ground surface which is connected to either the open atmosphere or to compressed air at suitable pressure (not shown) via pipe 721. Access to the atmosphere or pressurized air is controlled by an operable valve (not shown) in pipe 721.

By opening pipe 721 to atmospheric pressure and opening the valve on pipe 720, cell 718 fills with sea water, adding ballast to the cell system. By opening pipe 721 to compressed air and opening pipe 720 to the sea, the ballast is removed from cell 718 and replaced with compressed air. This both removes ballast weight and adds net buoyant forces to the cell system. These activities are performed concurrently with the addition or removal of cargo from cell interior 401, thus mitigating the external loads on the cell system on anchorage system 712 and the bottom soils.

Moreover, as will be understood, the operations of adding ballast or buoyancy are performed without large changes in pressure in the interior of cell 718. That is, by the nature of its operation, the pressure in the interior of cell 718 will at all times be similar to the sea water pressure outside, thus mitigating the loads on the walls of cell 718. The relatively small differential pressure between the inside and outside of cell 718 allows secondary cell 718 to be constructed of structural materials far less robust (and therefore less expensive) than the materials employed to construct cell 400.

Figure 8:
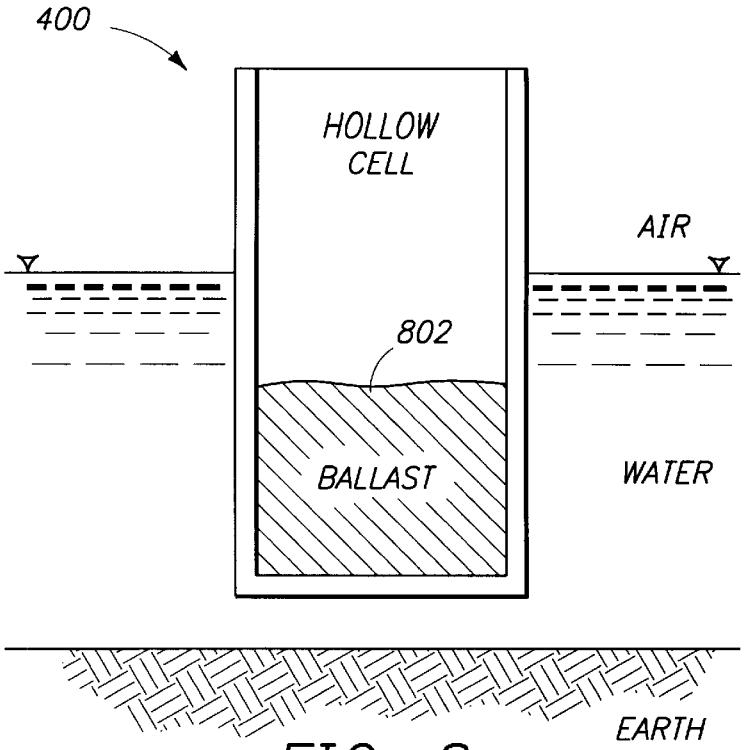
FIG. 8 is a cross section drawing of a single dock cell after it has been fabricated, ballasted and floated into position for final installation.

The individual cells may be fabricated either on site or off site. FIG. 8 depicts an individual cell 400 after fabrication, but before installation. The costs of fabrication will benefit from a production process that resembles manufacturing operations more than it resembles conventional on site construction operations for conventional docks. The cells may temporarily include ballast 802 as shown to provide stability. They can then be moved from their production location into final position in the dock either individually or in groups. If the cells are to be moved from a remote location to the installation site, the individual cells may be assembled into a barge-like assemblage and towed as a barge would be towed. It will be understood that an assembly of two or more rows of cells is inherently more stable in the water than a single cell or a single row of cells.

Figure 9:
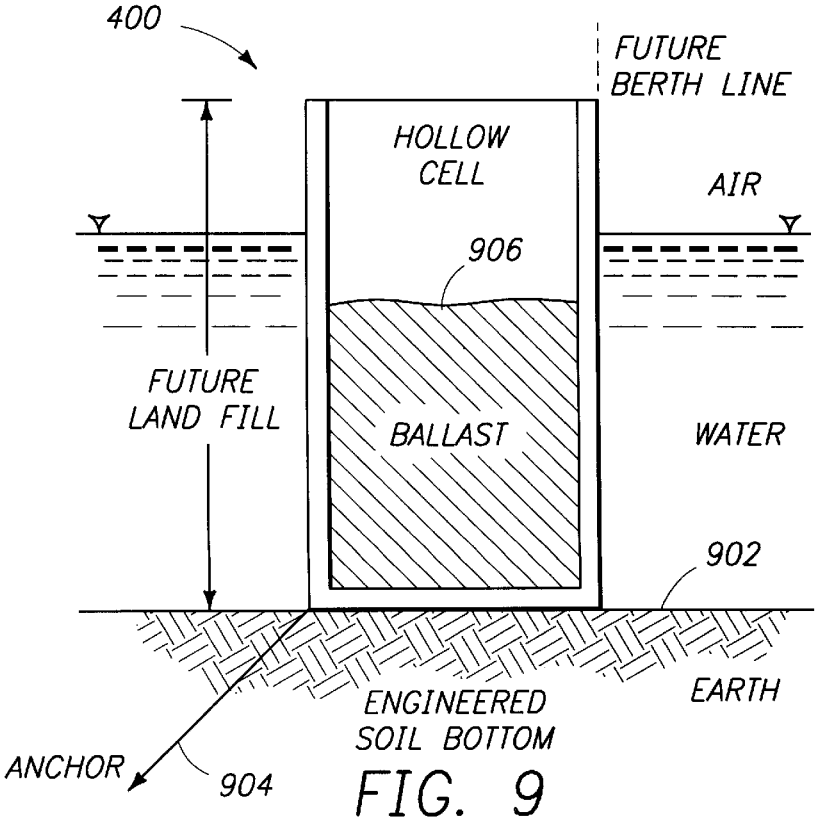
FIG. 9 is a cross section drawing of the typical dock cell after it has been further ballasted down to its final installation position and anchored. Subsequently, the land behind the cells will be filled, ballast will be removed and cargoes will be stored in the hollow cells.

FIG. 9 shows an individual cell 400 installed according to a specific embodiment. The soil 902 on which cell 400 is bearing has been engineered by the addition of materials and/or by earth consolidation techniques which are known in the construction industry. One or more earth anchors 904 have been installed. The anchor shown has been drilled and set in place according to techniques known in the construction industry. The strength, orientation and number of earth anchors have been structurally designed to resist the following forces: the net positive buoyant forces anticipated when the cells are empty, the "tipping over" tendency from lateral soil pressures which are bearing on the landward side of the dock, the tendency of the cells to slide toward the water as a result of soil pressures on the landward side of the cells and other forces particular to a given installation. The earth anchors shown are only one of many techniques that are available. Other approaches could include earth reinforcing techniques currently used for retaining walls, anchor piles, or perhaps even traditional sea anchors. Neither the method of anchoring the cells or rows of cells of the present dock invention, nor the orientation of the anchoring, will alter the novelty of the dock invention when employed in its intended uses.

After the cells have been anchored in the desired locations, they will have most of their weight supported by buoyant forces and a small residual amount supported by the engineered soils beneath. When the cells are emptied of ballast 906 in anticipation of receiving cargo, there will be a net positive buoyant force acting on the cells approximately equivalent to the weight of the ballast removed. Thereafter, any net positive buoyant force on the cells is taken up in the earth anchorage system that has been installed. As cargo and other loads are placed in or on the dock, they are resisted first by the net positive buoyant forces as the upward pull on the anchorage system is reduced accordingly. Once cargo and other loads have overcome all of the net positive buoyancy forces that were present when the cells were empty, the incremental additional loads are then resisted by the engineered soils in contact with the bottom of the cells.

Figure 10:
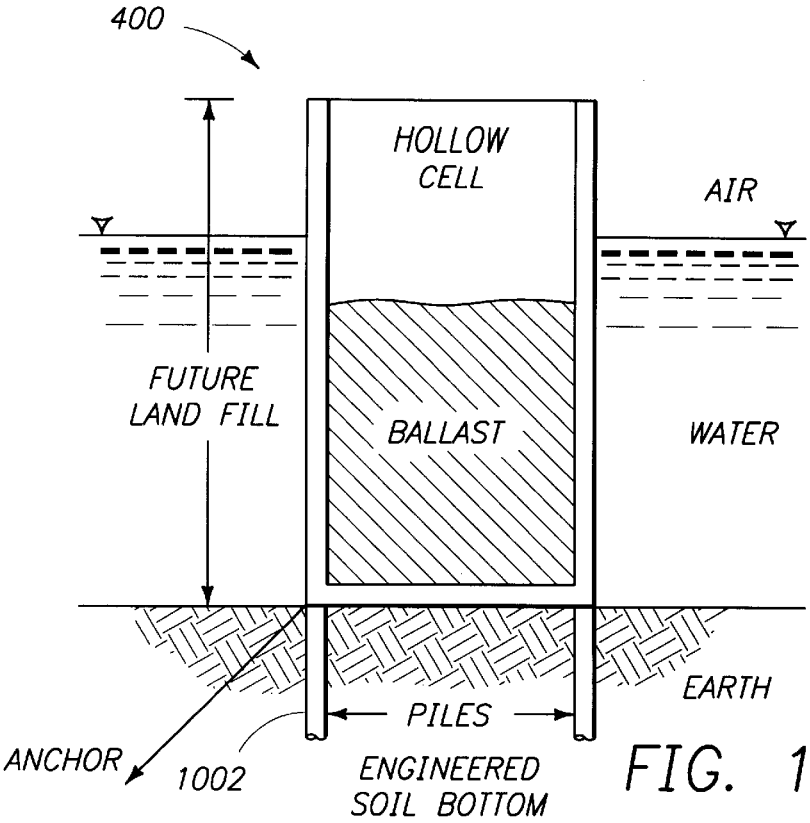
FIG. 10 is a cross section drawing of the same status as depicted in FIG. 8, except piles have now been added to overcome any load bearing deficiencies of the engineered soil on the bottom.

According to a specific embodiment, one can improve the total load bearing capacity of a given dock system by increasing the net positive buoyant force acting on the empty cells (e.g., reducing the dead weight of the cells), additional engineering and consolidation of the soils under the cell, increasing the footprint of a given cell on the soil below (for example by providing a wider bottom than the width of the cell itself), and adding load bearing piles 1002 to the system as depicted in FIG. 10.

According to a specific embodiment, the top side 402 of the installed cells will be removable, as shown in FIG. 4, so that standard shipping containers or other bulky cargo elements can be stored in the cells and conveniently retrieved. According to specific embodiments, neo bulk and dry or liquid bulk cargoes can also be stored in the cells, providing maximum flexibility in the cargo types that can be stored in the dock. According to another embodiment, the top side of the cell is fixed and the cell is used to store granular or liquid bulk materials. With a fixed top lid on the cells, such "flowable" bulk materials can be fed into and out of the cells through one or more small openings 404 in the side or top of the cells.

In either embodiment of the invention, flowable bulk materials can be fed into and out of the cells for storage at the same time that other vessel loading or unloading operations are taking place on the top surface of the cells. In either embodiment, the top surface of the cells is the functional equivalent of the rigid cargo transfer platform of the conventional dock. Moreover, the anchored cells replace the conventional earth retaining wall structure or armor protected bank slope which have constituted the most traditional means of stabilizing the earth slope in a conventional dock system.

In any embodiment of the present dock invention, the range of cargoes to be handled can also be increased by lining the cells with a variety of materials which would include liner characteristics such as low friction, inert, corrosion resistant, non-marring, waterproof, insulated, etc.; all of the same characteristics that are employed in lining storage compartments, tanks and vats used on land.

Figure 11:
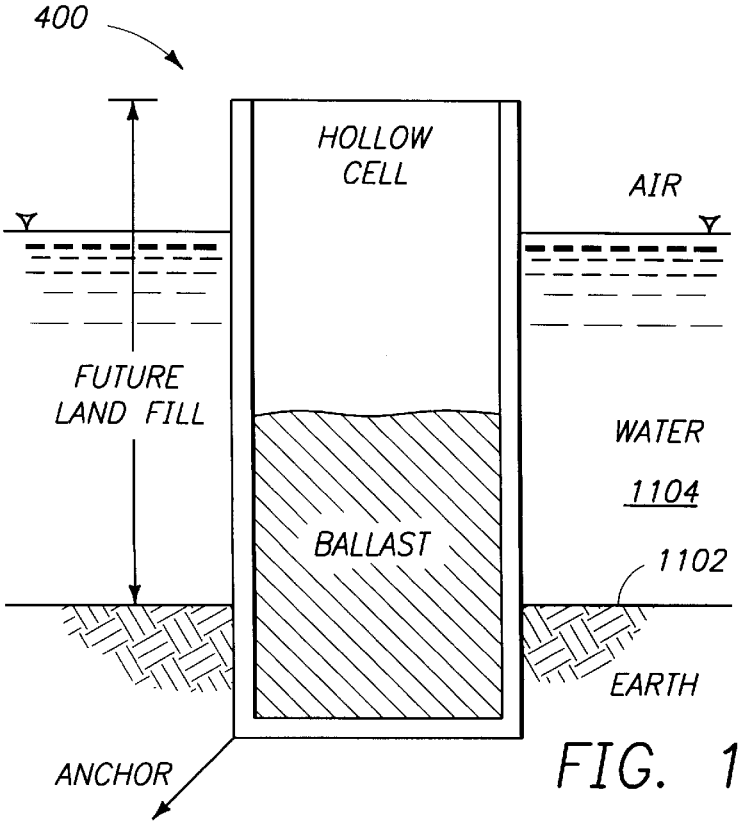
FIG. 11 is a cross section drawing of the case where the typical cell has an extended height dimension and is displacing soft muds for additional net positive buoyancy to bear cargo loads.

FIG. 11 shows another embodiment of the present invention that might be employed for several reasons. First, according to various embodiments, more storage capacity and more earth slope stability enhancement is achieved if the cells are fabricated tall enough so that they penetrate the bottom 1102 of the body of water 1104 when installed in their final location. In most circumstances, such an installation will also produce more net positive buoyant forces available to support the cargo loads.

There are other special circumstances where the envisioned dock may be installed in very deep water or in locations where there are soil materials below the cells that are so soft that they do not successfully resist the soil pressures that the cell bottoms attempt to transmit to them. In these installations additional net positive buoyant forces will be created by increasing the height dimension of the cells either to displace more water or to displace the soft "muds" on the bottom. Such soft bottom conditions exist specifically in places like San Francisco Bay and certain areas in the Gulf of Mexico. Most likely, there are many other similar locations. In such locations the soils are progressively more dense with depth, but they have little load bearing capacity. In such circumstances, the total downward load on the dock will be resisted by buoyant forces. Since these soils are more dense than water, their displacement by the cells will yield a higher net positive buoyant force than the displacement of water. Adapting the present dock invention to these conditions will create a "floating dock", albeit in a very different from that known in the current state of the floating docks art. The dock cells could be very deeply embedded into the bottom "mud" materials. Still, such a dock will be a significant improvement over the current art in floating docks and conventional docks in that the resulting cargo storage capacity will be vastly increased. In these soft bottom conditions the present dock invention will also exhibit superior structural performance under seismic loads, as the soft soils will move as "jello" when compared to dense, competent soils. In that seismic loads emanate from the earth and are transmitted into structures secured to the earth, the present dock invention will receive comparatively small seismic forces through the "jello".

Figure 12:
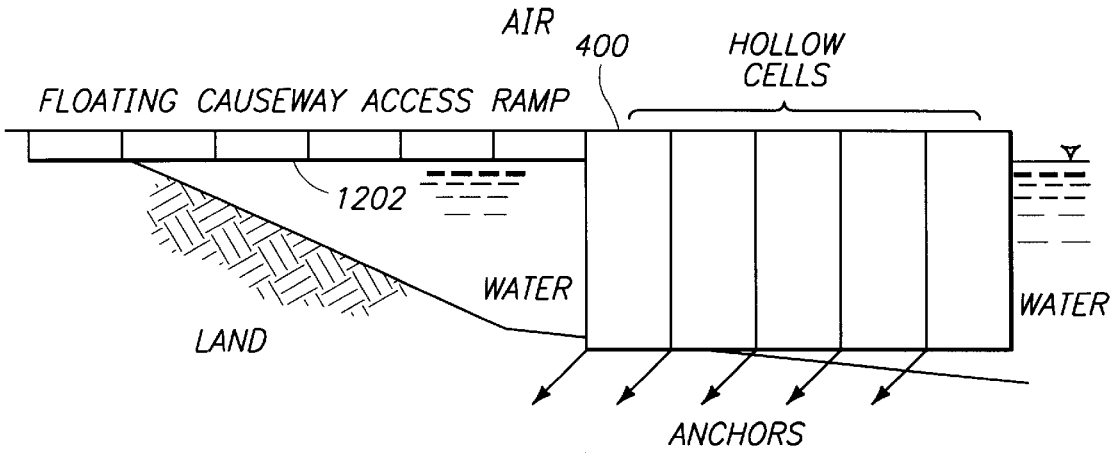
FIG. 12 is a cross section drawing of a series of rows of cells linked together as an island and installed in a near shore location at least partially in deep water. The island is shown having vehicle and railroad access from the shore via the present art of floating causeways.

FIG. 12 illustrates yet another embodiment of the present dock invention. It depicts a whole series of rows of watertight modular hollow cells 400 arrayed together for what is essentially an island dock to be used in a near shore, deep water installation. Some, or all, of the cells rest on or penetrate the bottom of the body of water in conditions as described above. In other installation locations some or all of the cells clear the bottom of the body of water. In either case, the island can be linked to the shore by access ramps 1202 which are fabricated according to the state of the floating causeway art. The FIG. 12 embodiment has at least two compelling cases for installation. There may be others.

The first case is where dredging for the depth of water needed is either impossible or too costly. In that case this embodiment of the present dock invention can be installed in deep water to obviate the need for dredging. The inherent storage capacity of the dock on and under the water overcomes the traditional needs for large surface areas of land. Cargoes can be shuttled to and from the island storage dock either across the floating causeway or by lighterage in smaller, shallow draft vessels in the absence of access ramps.

The second case is the military contingency operation in areas where suitable docks do not exist. In this embodiment of the present dock invention, segments of the island dock are towed to the place of the contingency operations, with military cargo in place in the cells. The cargo is then off loaded by available means. The island dock is anchored in place and serves as a replacement for the non-existent conventional dock. The storage capacity inherent in the island dock can be used to great advantage during the life of the contingency. Cargo ships can be turned around rapidly as cargoes flow directly between vessel and storage. The cargoes can then be fed ashore at the rate they are needed or at the maximum possible rate with available resources.

Figure 13A:
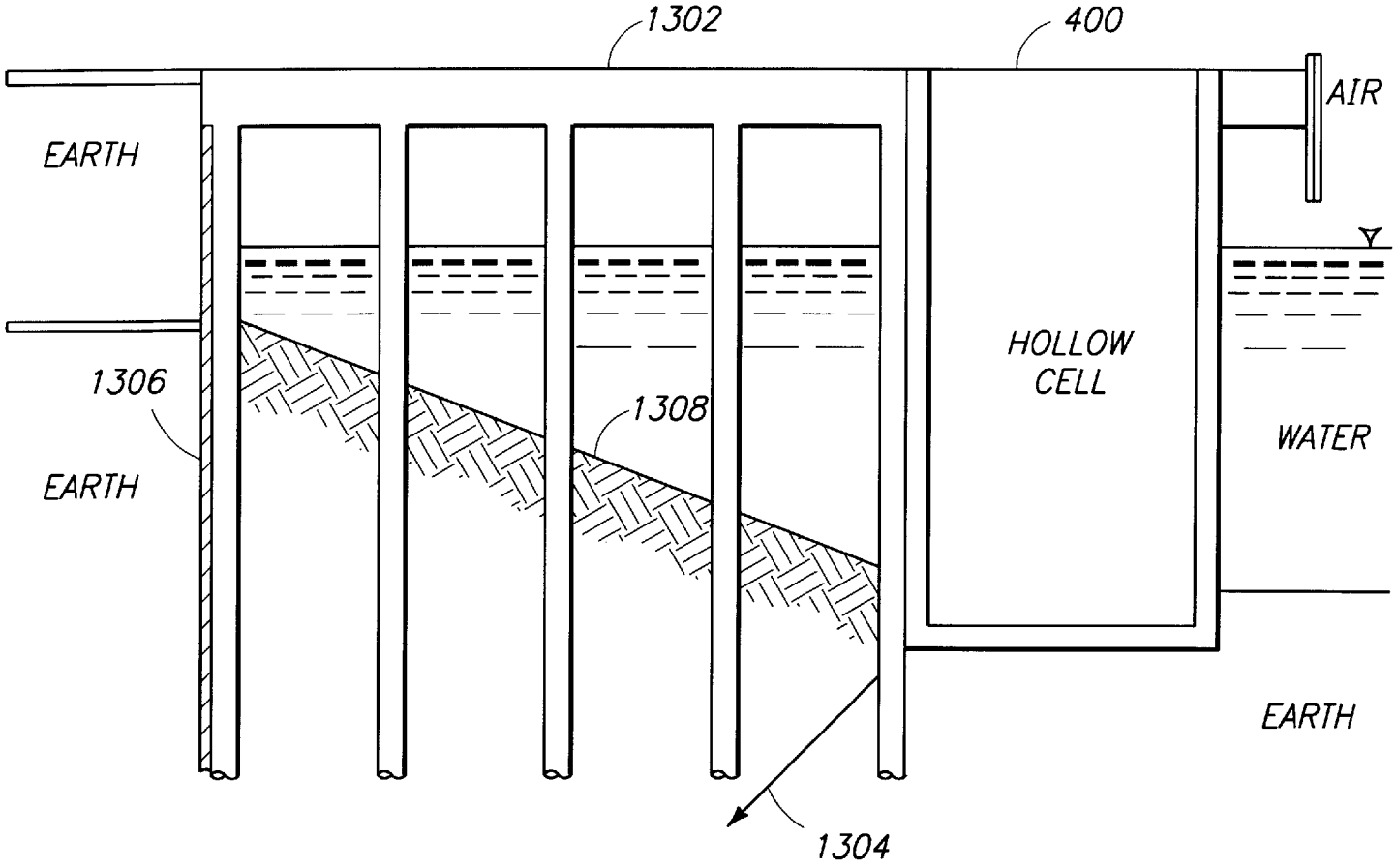
FIGS. 13A and 13B are cross section drawings showing how the present dock invention may be used to rehabilitate and enhance existing distressed docks of conventional design.

In another embodiment, the present dock invention is used to rehabilitate a distressed existing dock. This objective is accomplished by installing one or more rows of cells 400 along the face of an existing dock 1302 as depicted in FIG. 13A. According to one embodiment, the cells are designed for the deeper dredge depth desired at the existing berth and for the additional loads implied by the installation of a gantry or other crane. Installation of the cells will inherently provide the needed additional apron width at the existing berth. The piles of the existing pile supported platform can be used in the earth anchorage system needed to resist the net positive buoyant force that will act on the empty cells. A separate, new earth anchorage system 1304 can be installed as depicted if one wishes to avoid use of the existing piles. The anchorage system will not have to resist substantial earth slope stability forces so long as the existing retaining wall 1306 or stable armor protected earth slope 1308 stays intact. To avoid untimely failure of either existing system, one could selectively fill behind the newly installed cells to relieve the earth loads on the existing retaining structures. When the existing pile supported platform and the earth retaining structures reach their useful life, one can increase the earth anchorage of the cells to resist increased loads, demolish the remains of the existing pile supported platform, let the debris of demolition become fill behind the cells, fill and compact the remaining void behind the cells with engineered materials and pave the fills for cargo loads. A new dock, built to modern standards, will result.

Figure 13B:
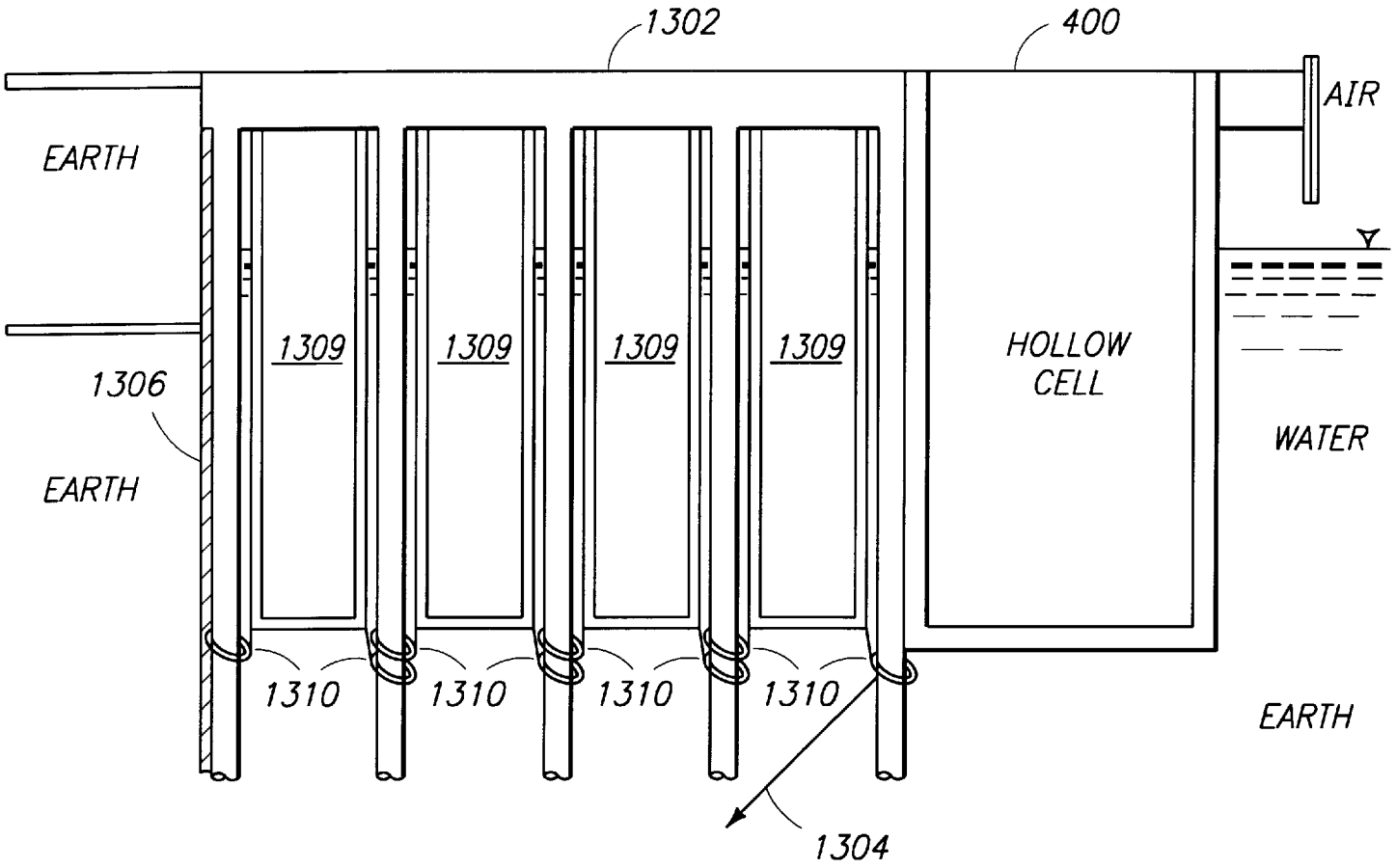

FIG. 13B shows modified cells 1309 which are adaptations of the basic cell 400. According to this embodiment, cells 1309 are employed to shore up the load carrying capacity of an existing dock either independently, or (as shown) in conjunction with the rehabilitation measures described above with reference to FIG. 13A. Cells 1309 are fabricated using techniques similar to those described herein for cell 400. Installation of cells 1309 will now be described.

In some instances, it may be necessary to dredge away existing soils and slope protection prior to the installation of cells 1309. The cells are then appropriately ballasted and floated into place under existing dock 1302. When each cell is correctly positioned, the ballast is carefully removed until it rises to come into firm contact with the underside of dock 1302. At that point, each cell 1309 is securely anchored to prevent them from rising further. Anchorage 1310 may be secured to existing piles (as shown), or it may be implemented according to a variety of techniques as described herein with reference to the anchorage of basic cells 400. There are some advantages associated with the use of existing piles. Such piles typically have significant uplift capacity which is unused by the original dock design. In addition, even though the upper portions of such piles (especially that portion in the "splash zone") may be severely deteriorated, the portion at or below the "mudline" is usually well preserved. In fact, the portions below the mudline can be expected to remain well preserved for many years due to the lack of oxygen beneath the mud. Oxygen is usually required for the deterioration mechanisms of such piles regardless of their material composition.

After cells 1309 have been securely anchored, additional ballast may be removed to create a net positive buoyancy which is then available to support loads on existing dock 1302. Thus, the net positive buoyancy forces supplied by the installation of cells 1309 can be used to replace the deteriorated load capacity of a degraded existing dock 1302, or to supplement and enhance the load carrying capacity of an intact existing dock 1302.

Figure 14:
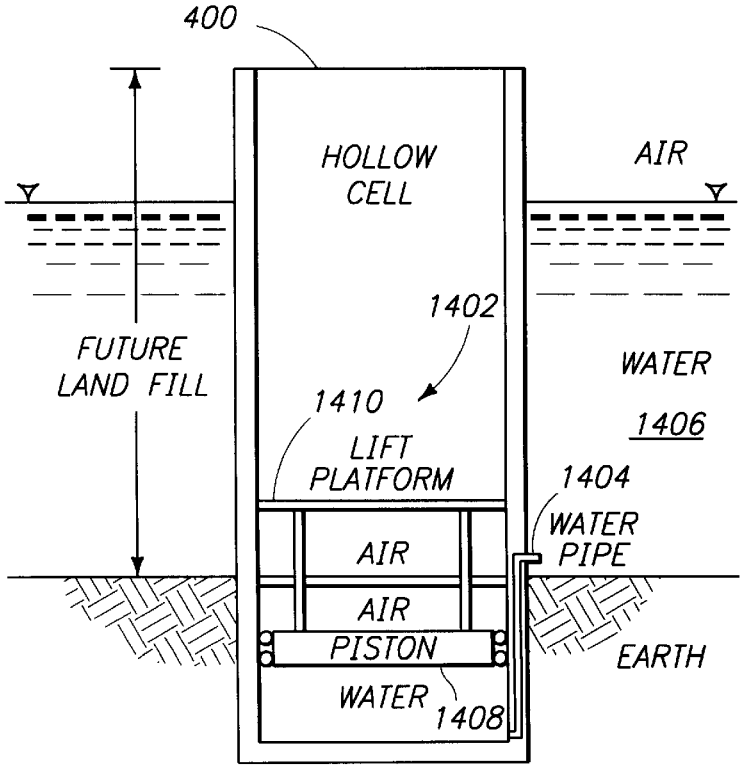
FIG. 14 is a cross section drawing of a single cell having a hydraulic lift which raises and lowers cargo in the cell using the sea water pressure available at the bottom of the typical cell installation.

When a new dock is built or an old dock is rehabilitated using the present dock invention concepts, cargoes may be stored in the cells in deep recesses above, at and below the water's surface. This will create the need for mechanical systems and devices which are capable of moving, especially lifting, the cargoes from the cells to the upper rigid cargo transfer platform of the dock. One such device, depicted in FIG. 14, is a natural extension of the basic concept of this invention. It harnesses the natural water pressure at the bottom of cell 400 to move an hydraulic cylinder 1402 which performs the work of lifting cargoes to the top of the cell. This is accomplished by opening a valve 1404 which allows external water 1406 to enter behind a piston 1408 which is attached to a platform 1410 upon which cargoes rest. As the external water floods into the space behind piston 1408 at the inherent pressure of the water depth where it enters, the piston is driven upward by the water pressure. The rising piston lifts the platform and cargo. When the desired height is reached, valve 1404 is closed and the incompressibility of the trapped fluids holds platform 1410 in place. When the cargo has been removed, the fluids behind piston 1408 are exposed to atmospheric pressure and are bled out of the space behind the piston with the assistance of a small pump (not shown), thus allowing platform 1410 to sink into position for its next cargo lift.

Figure 15:
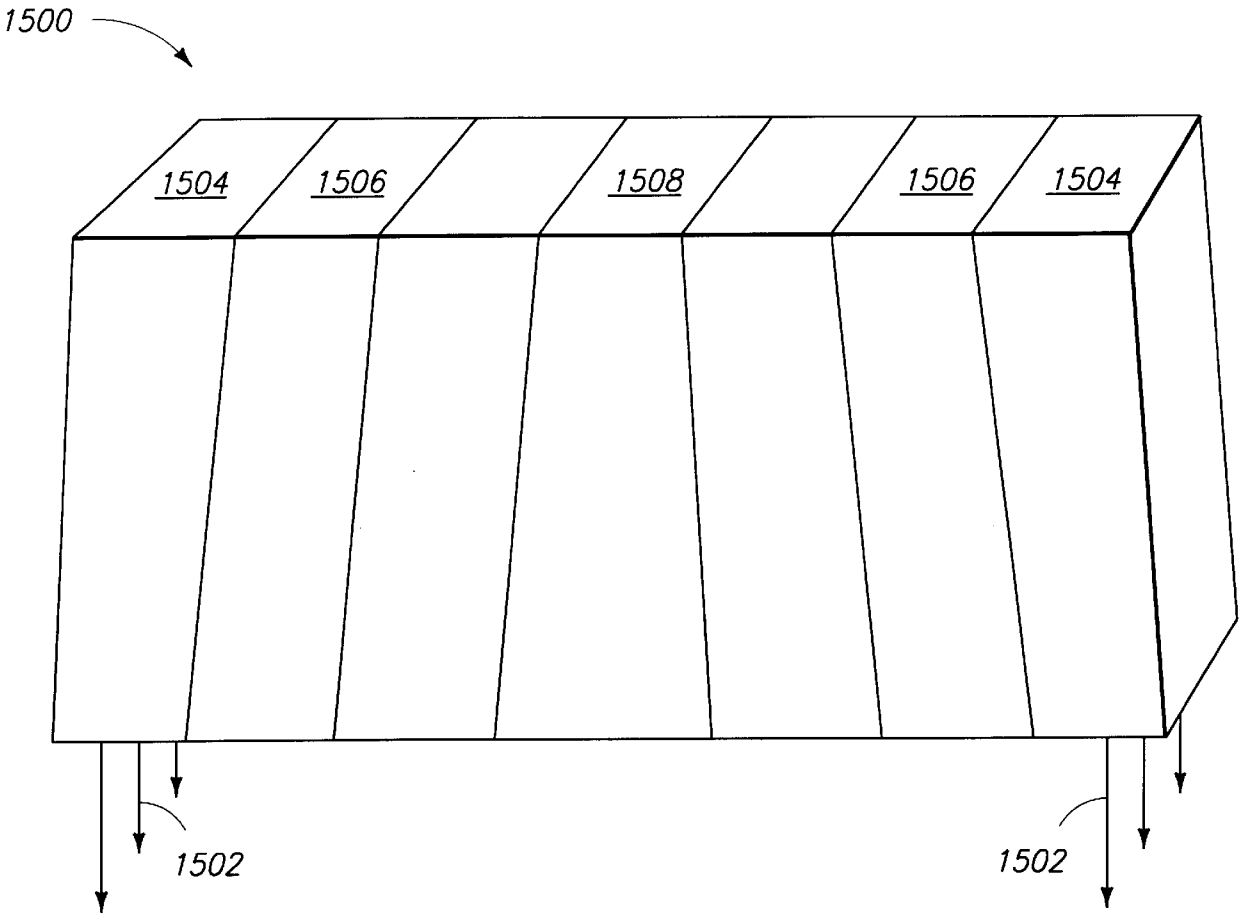
FIG. 15 is a perspective view of a row of cells designed according to a specific embodiment of the invention.

FIG. 15 is a perspective view of a dock structure 1500 designed according to a specific embodiment of the invention. This embodiment employs the principles of arch construction to harness the buoyancy forces of it interior modules. As shown, not all of the modules of dock 1500 are anchored to the underwater bed with anchors 1502. This is because the buoyancy of the interior modules is opposed by a component of the lateral (left and right) forces exerted by the sloping inner surfaces of anchor modules 1504. That is, the downward resistance of anchors 1502 to the buoyancy of anchor modules 1504 is converted into a lateral force against interior modules 1506 which, along with the friction between adjacent modules, counterbalances the lateral component of the buoyancy force associated with key module 1508 and interior modules 1506. Put simply, the wedge-like geometries of the interior modules of dock 1500 creates lateral forces which are resisted by the anchors at either end of the structure, just as the interior stones of an arch resist the force of gravity using the opposing forces of the keystone and the imposts. Of course, the geometries of the individual modules must be modified from the box-like embodiments described herein to ensure that the forces are transformed and harnessed appropriately. However, given that arch construction is an ancient and well documented technique, derivation of the appropriate geometries should be straightforward.

According to specific embodiments, the anchor modules 1504 may be partially or completely ballasted to provide the appropriate counterpoint to the buoyancy forces of the interior modules. While this result in a loss of storage area, the sacrificed volume is at either end of the dock, typically the least useful portion of the dock.

According to still more specific embodiments, the interfaces between modules may fit together in a variety of ways to oppose lateral (into- and out-of-page) forces on the dock from vessels or adjacent landfill. For example, the surface of an anchor module 1504 which contacts an interior module 1506 may be characterized by a concavity while the corresponding surface of the interior module is characterized by a convexity which conforms to the concavity. In another embodiment, the two surfaces may fit together with opposing "teeth" or interlocking channels or grooves. According to yet another embodiment, the modules may simply be fastened together by conventional means in addition to any of the interlocking interfaces. It will be understood that a variety of interface configurations are within the scope of the invention.

Caisson docks, where the caissons were filled to serve as gravity dams, have previously been built using one of about four construction techniques which may be employed for construction of the modular cells of the present invention. The most prevalent technique involves constructing a "starter" portion of a typical cell, e.g., the bottom of the cell plus 8 to 10 feet of the sides in a monolithic concrete pour in reusable forms inside a drydock. After the concrete has cured sufficiently, the drydock is flooded and the starter cell is floated out of the drydock and tied to the side of an existing dock. When the drydock has been vacated, construction of a new starter cell is commenced inside the drydock. In the meantime, "slip forms" are installed on the walls of the first starter cell that is now tied to the side of an existing dock. Concrete placement construction crews then place a series of lifts of concrete to complete the walls of the first cell, advancing the slip forms upward as each new lift has had sufficient curing time. This is a conventional construction technique for wall construction, one which is well known in the construction industry. The second starter cell is then removed from the drydock and its walls are slip-formed as the third starter cell is being built in the drydock. In this fashion, a smooth and efficient production technique can be set up, one which reuses the basic forms for the concrete pours. It is entirely possible to construct each entire cell in the drydock employing reusable forms.

Another construction technique which as been reported would involve constructing the starter cell on top of a conventional barge which is deployed in the water alongside a dock. Slip forms are installed on the walls of the starter cell as described above. At some point in the process of slip forming the walls, enough concrete weight will have been added to the barge to actually sink it below the water surface. When such a barge submerges while loaded with the starter cell, it may go through highly erratic movements that can be extremely dangerous. This should not be attempted without a thorough understanding of this behavior or without installed equipment to prevent catastrophic movements of the barge and cell. Experienced construction crews have managed to go through this transition safely. They then proceed to flood the barge compartments and sink it in relation to the concrete cell which then floats independently. The cell then supports itself and the remaining slip-forming wall construction activities. The barge is pumped full of air to displace water from its compartments, after being removed from the vicinity of the starter cell, and is thereby refloated for its next use. The barge will be extremely unstable and erratic again as it transitions from is sunk condition to a floating condition. this procedure will also be extremely dangerous for an inexperienced crew.

According to another specific embodiment, the benefits and efficiencies inherent in the barge technique described above are replicated using a "syncro-lift" device which is commonly available in the small ship/boat repair industry. This is essentially a barge-like platform which is raised from and lowered under the water with synchronous motors mounted on piles at the four corners of the platform. Starter cells would be efficiently constructed on the raised sychro-lift platform, the reusable forms stripped, the wall slip forms installed and the starter cell launched into the water by lowering the sychro-lift platform.

Another technique for constructing the cells of the present invention involves constructing the starter cell on a conventional ship way or a marine railway. When the concrete has sufficiently cured and the forms have been stripped, the wall slip forms are mounted and the starter cell is launched much in the same way a boat or ship is launched. This approach could be used for constructing the full sized cell as well as for constructing a starter cell which is later completed while afloat.

In any of the approaches described above, the question of whether to form and construct full sized cells versus starter cells followed by slip forming of the walls is almost entirely a construction cost question, and will depend on crew skills, materials and equipment.

Figure 16:
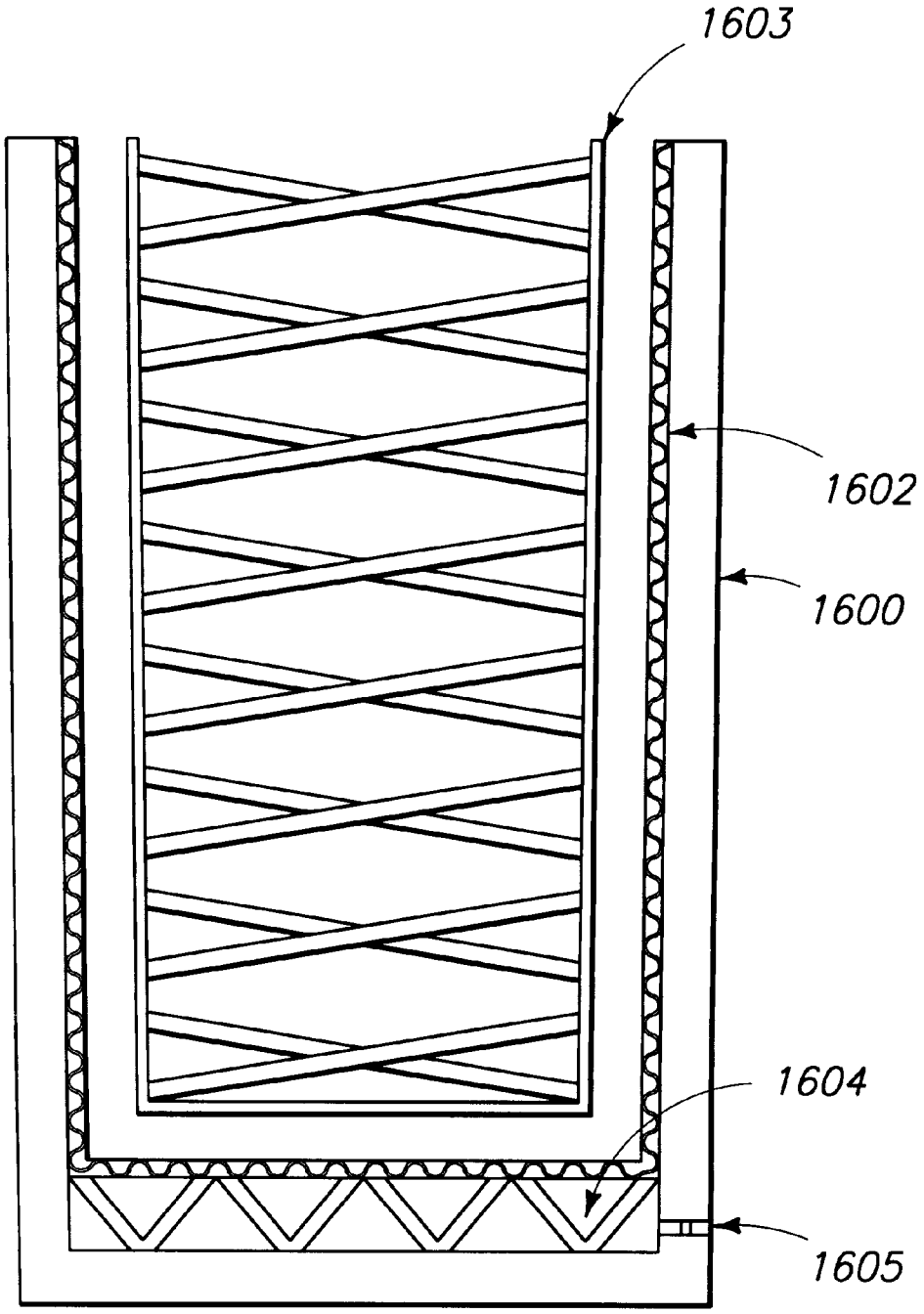
FIGS. 16–20 illustrate construction of a dock cell according to a specific embodiment of the invention.

According to the present invention, FIGS. 16 through 20 illustrate yet another technique for constructing full sized cells either for a given dock installation or for a plurality of dock installations. FIG. 16 shows a complete assembly of construction apparatus employed in this technique. Drydock 1600 is a reinforced concrete cell that has been constructed using one of the techniques described above. Its inside dimensions are determined by the outer dimensions of the dock cells that one plans to construct with drydock 1600. The inside surface of drydock 1600 is the outer form for constructing the new cells. Drydock 1600 is constructed with its walls sloped slightly outward as the wall height increases, i.e., the inner dimensions of the drydock are tapered. This allows any concrete that is cured inside drydock 1600, using the drydock wall as the outer form, to be easily freed from adherence to the drydock wall when a newly constructed cell is raised slightly. To further facilitate the removal of a newly constructed cell, a low friction liner 1602 is applied to the interior walls of drydock 1600. Drydock 1600 has a secondary false bottom 1604 which is also coated with liner 1602. The area below false bottom 1604 is hollow. A seacock 1605 provides a passageway from the pressurized sea water to the hollow area beneath false bottom 1604. Seacock 1605 is a valve that either allows pressurized sea water to enter the hollow area below false bottom 1604 or shuts off the pressurized sea water depending on the setting of the valve.

Hollow, rigid inner form 1603 is constructed of a permanent, reusable material, e.g., steel. Like drydock 1600, the outer dimensions of inner form 1603 are tapered, i.e., they increase with its height, to facilitate its extraction from drydock 1600. Inner form 1603 is designed structurally both to resist the loads which are applied when concrete is poured into the interstitial space between it and drydock 1600, as well as the loads imposed as a crane hoists inner form 1603 into drydock 1600 before the pour and out of drydock 1600 after the concrete has sufficiently cured. According to specific embodiments, inner form 1603 is coated with a low friction coating material. Not shown in FIG. 16 is a floating drydock door which completes the drydock enclosure by sealing the open side of drydock 1600, i.e., the side facing out of the page. The drydock door is designed, constructed and operated according to the latest state -of- the- art for graving dock doors.

Figure 17:
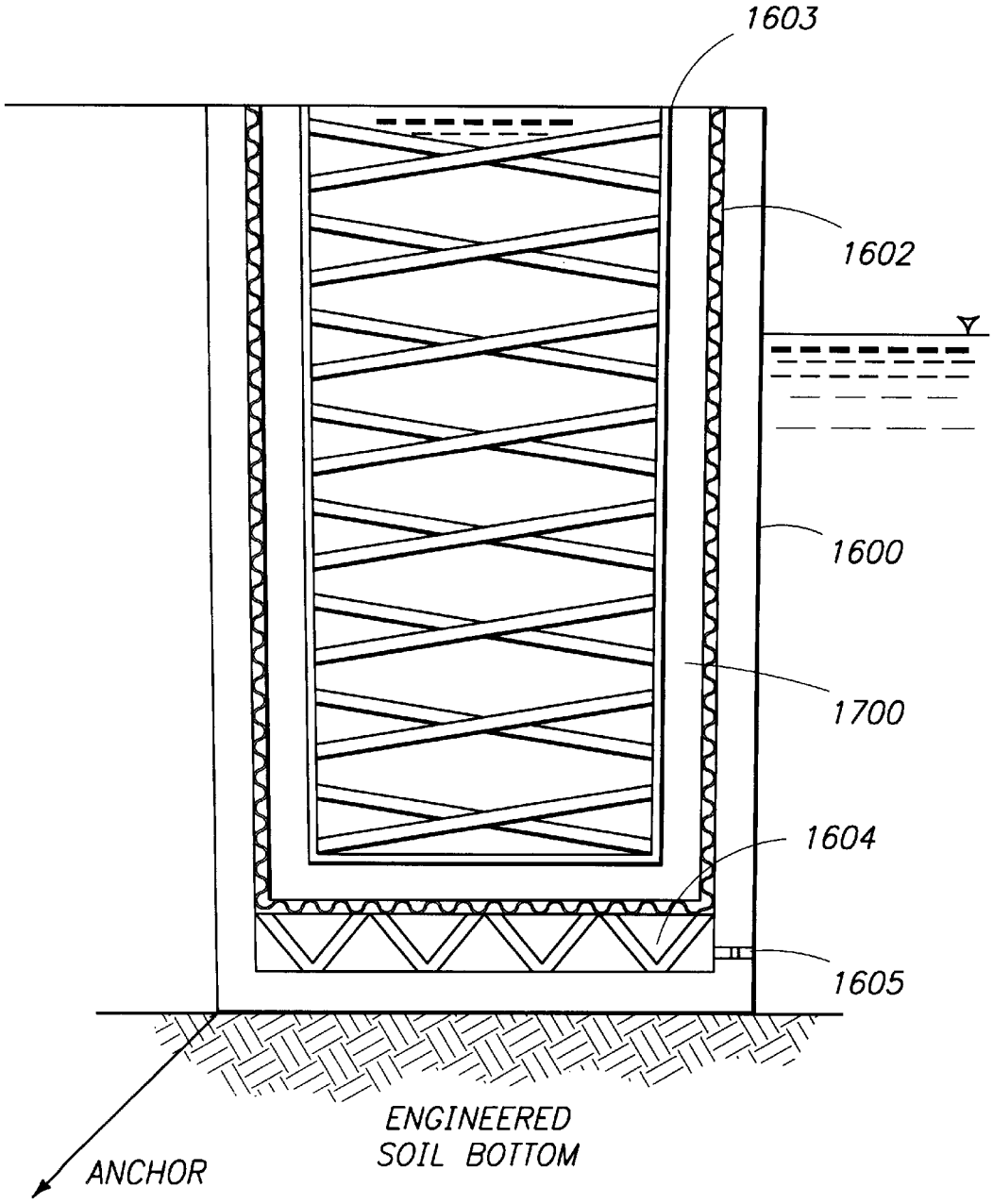
Figure 18:
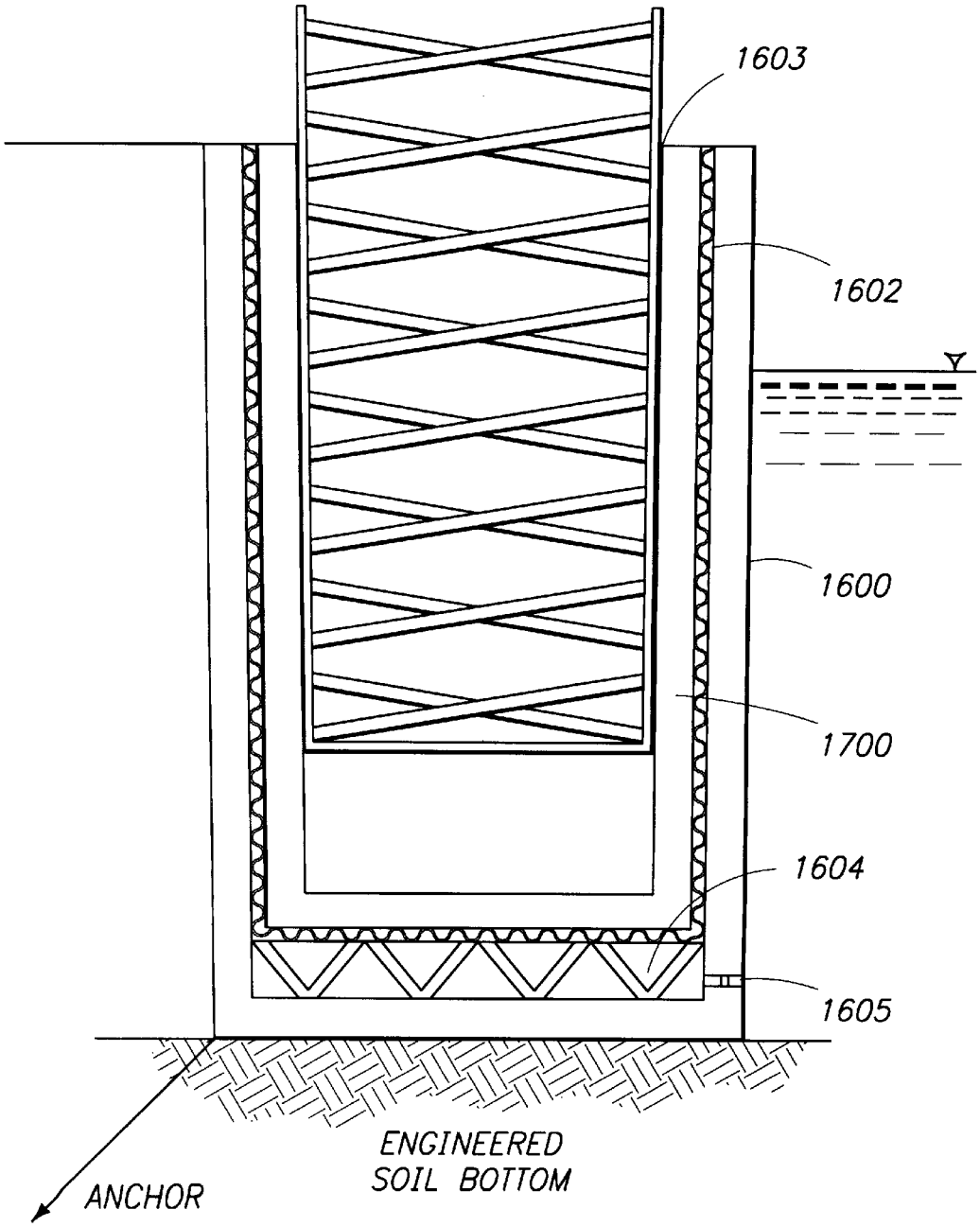
Figure 19:
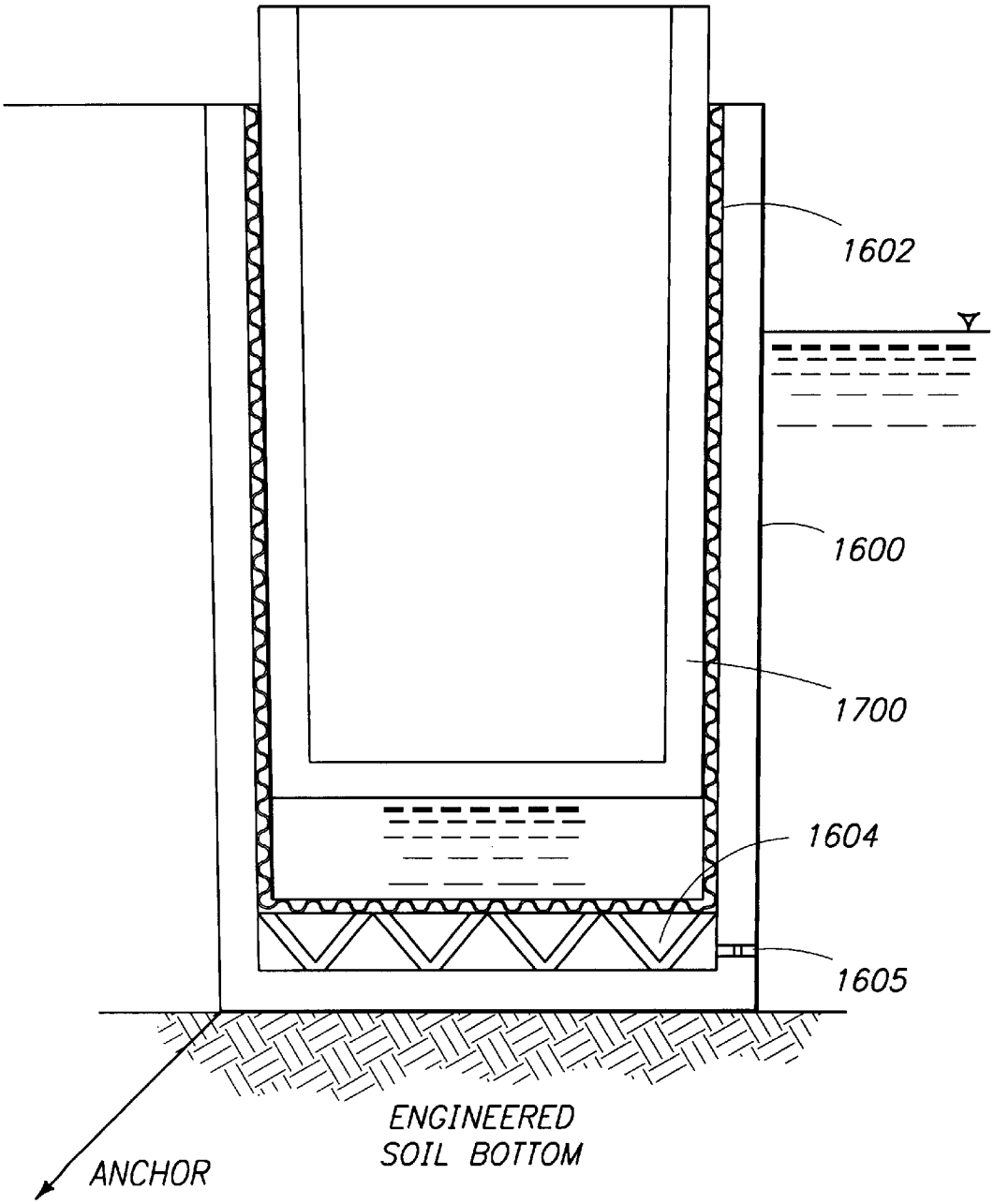

FIG. 17 shows a cross-section of the drydock/construction form apparatus of the present invention, in place and with reinforced concrete 1700 poured in place. Concrete 1700 is allowed to cure a sufficient time to achieve the structural integrity needed to allow it to be extracted from drydock 1600. After the appropriate curing time interval, inner form 1603 is lifted out of drydock 1600 with a crane or other appropriate piece of construction equipment as shown in FIG. 18. Next, seacock 1605 is opened, allowing pressurized sea water to enter the hollow area below false bottom 1604. This pressurized sea water dislodges newly constructed cell 1700 from drydock 1600, as shown in FIG. 19, and floats it upward until seacock 1605 is closed to the outside pressurized sea water. At this point, water or other ballast materials, are placed inside the newly constructed cell until it is stabilized for independent floating outside drydock 1600. Finally, the floating door (not shown) to drydock 1600 is removed and the newly constructed cell 1700 is towed out of drydock 1600.

Figure 20:
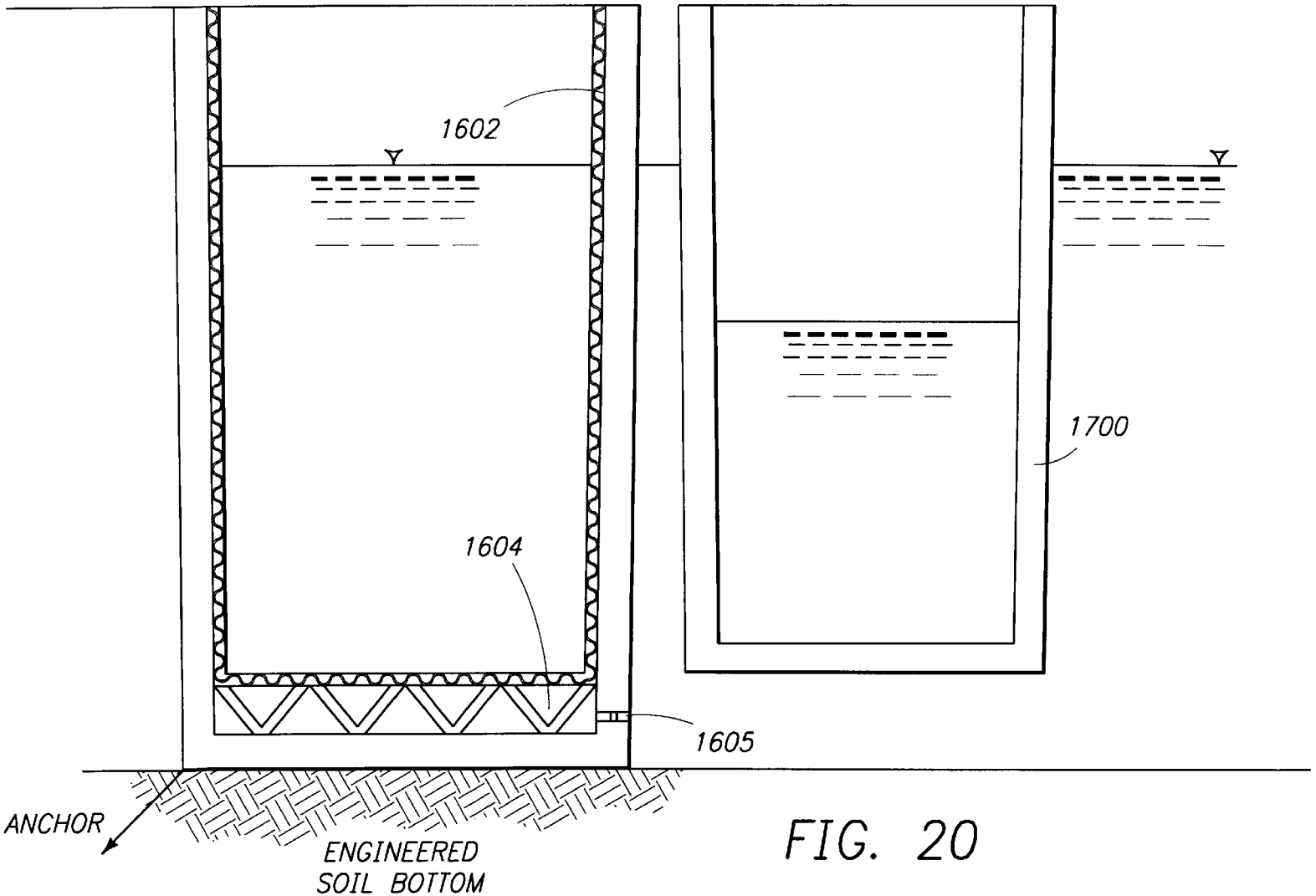

FIG. 20 shows newly constructed cell 1700 floating independently, outside drydock 1600. Cell 1700 is now ready to be towed into position for installation in the new dock structure. Drydock 1600 is now also ready to have the floating door reinstalled, the sea water pumped out, inner form 1603 reinstalled and a new cell construction to be started.

According to a specific embodiment, drydock 1600 and its complete assembly are designed as the initial cell for a new cellular storage dock construction. Other cells can be installed and attached to drydock 1600 in the manner described above. According to other embodiments, drydock 1600 is built as a permanent manufacturing point for many future cellular storage docks. Cells manufactured at drydock 1600 can be assembled and towed as barges to installation locations hundreds of miles away from the site of drydock 1600.

While the invention has been particularly shown and described with reference to specific embodiments thereof, it will be understood by those skilled in the art that changes in the form and details of the disclosed embodiments may be made without departing from the spirit or scope of the invention. For example, the embodiments described above employ rectangular box like structures for the individual hollow modules. It will be understood, however, that a wide variety of cell configurations are within the scope of the invention. For example, hollow cylindrical cells may be employed having circular, elliptical, or polygonal cross-sections as well as rectangular cross-sections. Furthermore, the top deck of each cell may be larger and shaped differently than the cross-section of the storage cylinder below resulting in a structure in which the portion of the cells extending below the water are not immediately adjacent each other. Therefore, the scope of the invention should be determined with reference to the appended claims.

What is claimed is:

1. A maritime dock structure, comprising:

at least one hollow module having a buoyancy force associated therewith due to an interior volume; and at least one anchor coupled to each module and embedded in an underwater bed, each anchor opposing the buoyancy force of an associated module as well as lateral forces exerted on the associated module and load forces directed into the underwater bed.

2. The maritime dock structure of claim 1 further comprising a cover for the at least one module, wherein the cover operates as a working deck for cargo operations, and wherein the interior volume of the at least one module is designed to store goods.

3. The maritime dock structure of claim 2 wherein the cover is removable to provide access to the interior volume of the associated module.

4. The maritime dock structure of claim 2 wherein the cover comprises a hatch for providing access to the interior volume of the associated module.

5. The maritime dock structure of claim 2 wherein the at least one module is constructed of materials which are suitable to store at least one of bulk goods and standard storage containers.

6. The maritime dock structure of claim 5 wherein the at least one module is constructed of reinforced concrete.

7. The maritime dock structure of claim 5 wherein the interior volume of the at least one module is designed to accommodate liquid goods.

8. The maritime dock structure of claim 5 wherein the interior volume of the at least one module is designed to accommodate dry goods.

9. The maritime dock structure of claim 2 wherein the interior volume of the at least one module is lined with a water resistant material.

10. The maritime dock structure of claim 2 wherein the at least one module comprises an hydraulic system for lifting and lowering the goods within the interior volume of the at least one module.

11. The maritime dock structure of claim 10 wherein the hydraulic system employs external water pressure to effect lifting of the goods.

12. The maritime dock structure of claim 10 wherein the hydraulic system employs a bleed down device to effect lowering of the goods by releasing trapped pressure into the atmosphere.

13. The maritime dock structure of claim 2 further comprising loading and unloading mechanisms for loading the goods into and unloading the goods from the interior volume of the at least one module.

14. The maritime dock structure of claim 13 wherein the loading and unloading mechanisms comprise a standard cargo container crane.

15. The maritime dock structure of claim 13 wherein the loading and unloading mechanisms comprise conveyor systems for bulk goods.

16. The maritime dock structure of claim 1 wherein the at least one module is in contact with the underwater bed.

17. The maritime dock structure of claim 16 further comprising the underwater bed, wherein the underwater bed is engineered to provide enhanced load bearing capabilities.

18. The maritime dock structure of claim 16 further comprising the underwater bed, wherein the underwater bed is graded.

19. The maritime dock structure of claim 1 wherein the at least one module is not in contact with the underwater bed.

20. The maritime dock structure of claim 1 wherein the at least one module comprises a plurality of hollow modules arranged in a single row.

21. The maritime dock structure of claim 1 wherein the at least one module comprises a plurality of hollow modules arranged in a plurality of adjacent rows.

22. The maritime dock structure of claim 1 wherein the at least one module comprises a plurality of hollow modules arranged between land and water wherein the maritime dock structure further comprises a portion of the land.

23. The maritime dock structure of claim 22 wherein the portion of the land comprises landfill.

24. The maritime dock structure of claim 1 wherein the at least one module comprises a plurality of hollow modules surrounded by water.

25. The maritime dock structure of claim 24 wherein the plurality of hollow modules are connected to land via a floating access ramp.

26. The maritime dock structure of claim 25 wherein the floating access ramp provides rail access to the structure.

27. The maritime dock structure of claim 25 wherein the floating access ramp provides vehicle access to the structure.

28. The maritime dock structure of claim 1 wherein the at least one hollow module comprises a six-sided box.

29. The maritime dock structure of claim 1 wherein the at least one hollow module comprises a cylindrical cell having a cross-section.

30. The maritime dock structure of claim 29 wherein the cross-section comprises a rectangle.

31. The maritime dock structure of claim 29 wherein the cross-section comprises an ellipse.

32. The maritime dock structure of claim 29 wherein the cross-section comprises a polygon.

33. The maritime dock structure of claim 1 wherein the at least one anchor comprises an anchor pile.

34. The maritime dock structure of claim 1 wherein the at least one anchor comprises a sea anchor.

35. The maritime dock structure of claim 1 wherein the at least one anchor comprises a flexible material.

36. The maritime dock structure of claim 35 wherein the flexible material comprises steel netting.

37. The maritime dock structure of claim 35 wherein the flexible material comprises a plurality of interconnected vehicle tires arranged in a two-dimensional pattern.

38. The maritime dock structure of claim 1 wherein the at least one anchor comprises a fabricated slab.

39. The maritime dock structure of claim 1 further comprising at least one load bearing pile in contact with the at least one hollow module and at least partially embedded in the underwater bed for enhancing the load bearing capabilities of the maritime dock structure.

40. A maritime dock structure, comprising:

a hollow module having a buoyancy force associated therewith due to an interior volume; and an anchor coupled to the hollow module and embedded in an underwater bed, the anchor opposing the buoyancy force of the hollow module as well as lateral forces exerted on the hollow module and load forces directed into the underwater bed.

41. A maritime dock structure, comprising:

a plurality of hollow modules each having a buoyancy force associated therewith due to an interior volume; and a plurality of anchors coupled to the modules and embedded in an underwater bed, the anchors opposing the buoyancy forces of the hollow modules as well as lateral forces exerted on the hollow modules and load forces directed into the underwater bed.

42. The maritime dock structure of claim 41 wherein the plurality of modules are arranged in a row, the row comprising a key module, and two anchor modules, the plurality of anchors being coupled to the anchor modules, each of the key and anchor modules having a geometry which results in the buoyancy force associated with the key module being opposed by the two anchor modules.

43. The maritime dock structure of claim 42 wherein the row further comprises interior modules between the key module and each of the anchor modules, the buoyancy force associated with the key modules being opposed by the two anchor modules via the interior modules.

44. The maritime dock structure of claim 42 wherein the two anchor modules contain ballast to additionally oppose the buoyancy force associated with the key module.

45. A method of constructing a maritime dock structure, comprising:

floating at least one hollow module into an installation position;

loading ballast into the at least one module to oppose a buoyancy force associated therewith due to an interior volume thereby causing the at least one module to sink to a desired depth;

anchoring the at least one module with at least one anchor embedded in an underwater bed, the at least one anchor opposing the buoyancy force of the at least one module and load forces directed into the underwater bed; and removing at least some of the ballast from the at least one module.

46. The method of claim 45 further comprising, before loading ballast into the at least one module, providing at least one load bearing pile in the underwater bed to enhance the load bearing capabilities of the structure.

47. The method of claim 45 wherein the at least one hollow module is ballasted to come into contact with the underwater bed.

48. The method of claim 47 further comprising, before loading ballast into the at least one module preparing the underwater bed such that the at least one hollow module comes into substantially uniform contact with the underwater bed.

49. The method of claim 45 further comprising fabricating the at least one hollow module at a location remote from the installation location and towing the at least one hollow module to the installation location.

50. The method of claim 45 wherein the at least one module comprises a plurality of modules which are coupled together, loading ballast into the at least one module comprising ballasting and sinking the plurality of modules substantially simultaneously.

51. The method of claim 45 wherein the at least one module comprises a plurality of modules, loading ballast into the at least one module comprising ballasting and sinking each of the plurality of modules individually.

52. The method of claim 45 wherein the at least one anchor comprises an earth anchor, the method further comprising, before loading ballast into the at least one module drilling the earth anchor into the underwater bed.

53. The method of claim 45 wherein the at least one anchor comprises a flexible material having a surface area, the method further comprising:

covering a first portion of the flexible material with first landfill, the first portion being for connection to a bottom edge of the at least one hollow module;

folding a second portion of the flexible material back on the first landfill for connection to an upper part of the at least one hollow module; and covering the second portion with second landfill;

wherein the buoyancy and lateral forces are opposed by soil pressures on the flexible material.

54. The method of claim 53 wherein the flexible material comprises a plurality of interconnected vehicle tires arranged in a two-dimensional pattern.

55. A method for rehabilitating an existing dock having a berth line and an apron width, comprising:

positioning at least one hollow module adjacent the berth line in contact with the existing dock structure, each hollow module having a buoyancy force associated therewith due to an interior volume; and embedding an anchor coupled to the module in an underwater bed, the anchor opposing the buoyancy force of the at least one module as well as lateral forces and load forces directed into the underwater bed;

wherein the at least one hollow module increases the apron width of the existing dock.

56. A method for unloading goods from a cargo ship at a maritime dock structure comprising a hollow module having a buoyancy force associated therewith due to an interior volume, and an anchor coupled to the module and embedded in an underwater bed, the anchor opposing the buoyancy force of the hollow module, lateral forces corresponding to the cargo ship, and load forces directed into the underwater bed, the method comprising:

securing the cargo ship to the dock structure;

transferring the goods from the cargo ship into the hollow module;

releasing the cargo ship from the dock structure; and transferring the goods from the hollow module to another mode of transportation.

57. A method for loading goods into a cargo ship at a maritime dock structure comprising a hollow module having a buoyancy force associated therewith due to an interior volume, and an anchor coupled to the module and embedded in an underwater bed, the anchor opposing the buoyancy force of the hollow module, lateral forces corresponding to the cargo ship, and load forces directed into the underwater bed, the method comprising:

transferring the goods from a first mode of transportation into the hollow module;

securing the cargo ship to the dock structure;

transferring the goods from the hollow module into the cargo ship; and releasing the cargo ship from the dock structure.

58. A method for anchoring a structure abutting landfill comprising:

securing a flexible anchor material to a lower portion of the structure, the flexible material comprising a plurality of interconnected vehicle tires arranged in a two-dimensional pattern;

covering a first portion of the flexible anchor material with a first portion of the landfill;

folding a second portion of the flexible anchor material over the first portion of the landfill;

securing the second portion of the flexible anchor material to an upper portion of the structure; and covering the second portion of the flexible anchor material with a second portion of the landfill;

wherein lateral forces on the structure and a buoyancy force associated with the structure are resisted in part by soil pressures on the flexible anchor material.

59. A met hod for constructing a hollow cell structure from a first material, the hollow cell structure having inner and outer dimensions, the method comprising:

providing a drydock having inner dimensions, and a removable door for providing an opening in the side of the drydock, the inner dimensions of the drydock being substantially the same as the outer dimensions of the hollow cell structure;

inserting an inner form structure having outer dimensions into the drydock such that an interstitial space remains between the inner form structure and the drydock, the outer dimensions of the inner form structure being substantially the same as the inner dimensions of the hollow cell structure;

filling the interstitial space with the first material;

curing the first material to form the hollow cell structure;

removing the inner form structure from the drydock; and removing the hollow cell structure from the drydock via the removable door.

60. The method of claim 59 wherein the inner dimensions of the drydock and the outer dimensions of the inner form structure are tapered to facilitate removal of the hollow cell structure.

61. The method of claim 59 wherein the removable door comprises a graving dock door.

62. The method of claim 59 wherein the inner form structure is inserted and removed with a crane.

63. The method of claim 59 wherein the first material comprises reinforced concrete.

64. The method of claim 59 wherein the drydock further comprises an inner surface, the inner surface being coated with a low friction material to facilitate removal of the hollow cell structure.

65. The method of claim 59 wherein the drydock further comprises a false bottom and a valve for allowing water external to the drydock to flood a volume below the false bottom, and wherein removing the hollow cell structure from the drydock comprises:

opening the valve thereby flooding the volume and causing the hollow cell structure to float upward within the drydock;

removing the removable door of the drydock thereby providing an opening in the side of the drydock;

floating the hollow cell structure out of the drydock through the opening.

66. The method of claim 65 wherein a plurality of hollow cell structures are constructed and employed to construct a maritime structure, the method further comprising:

floating each of the hollow cell structures into a corresponding installation position;

loading ballast into each of the hollow cell structures to oppose a buoyancy force associated therewith thereby causing each of the hollow cell structures to sink to a desired depth;

anchoring each of the hollow cell structures with at least one anchor embedded in an underwater bed thereby forming the maritime structure, the at least one anchor opposing the buoyancy force of its associated hollow cell structure; and removing at least some of the ballast from each of the hollow cell structures.

67. The method of claim 66 wherein floating each of the hollow cell structures into position comprises abutting at least one of the hollow cell structures to the drydock thereby incorporating the drydock into the maritime structure.

68. An apparatus for constructing a hollow cell structure from a first material, the hollow cell structure having inner and outer dimensions, the apparatus comprising:

a drydock having inner dimensions and a removable door, the inner dimensions of the drydock being substantially the same as the outer dimensions of the hollow cell structure, the removable door being for providing an opening in the side of the drydock for removal of the hollow cell structure; and an inner form structure for insertion into the drydock, the inner form structure having outer dimensions such that an interstitial space remains between the inner form structure and the drydock when the inner form structure is inserted therein, the outer dimensions of the inner form structure being substantially the same as the inner dimensions of the hollow cell structure.

69. The apparatus of claim 68 wherein the inner dimensions of the drydock and the outer dimensions of the inner form structure are tapered to facilitate removal of the hollow cell structure.

70. The apparatus of claim 65 wherein the removable door comprises a graving dock door.

71. The apparatus of claim 68 wherein the drydock further comprises an inner surface, the inner surface being coated with a low friction material to facilitate removal of the hollow cell structure.

72. A method for rehabilitating an existing dock supported by a plurality of existing piles having spacing therebetween, the existing dock having an underside and a load carrying capacity, the method comprising:

positioning at least one hollow module in the spacing between the existing piles, each hollow module having a buoyancy force associated therewith; and employing at least one anchor coupled to the at least one hollow module and embedded in an underwater bed, the at least one anchor opposing the buoyancy force of the at least one hollow module;

wherein the at least one hollow module is in contact with the underside of the existing dock, the buoyancy force associated with the at least one hollow module thereby enhancing the load carrying capacity of the existing dock.

73. The method of claim 72 wherein the at least one anchor comprises at least a portion of at least one of the existing piles.

74. A maritime dock structure, comprising:

at least one hollow module having a buoyancy force associated therewith;

at least one anchor coupled to each module and embedded in an underwater bed, each anchor opposing the buoyancy force of an associated module as well as lateral forces exerted on the associated module; and a secondary module having a buoyancy force associated therewith and an interior, the secondary module supporting the at least one hollow module, the secondary module having a first access conduit for allowing a flow of pressurized air to and from the interior of the secondary module, the secondary module also having a second access conduit for allowing a flow of water to and from the interior of the secondary module;

wherein the buoyancy of the secondary module is manipulated using the flow of pressurized air and the flow of water to compensate for loads acting on the at least one hollow module.

75. A structure, comprising:

at least one hollow module having a buoyancy force associated therewith due to an interior volume; and at least one anchor coupled to each module and embedded in an underwater bed, each anchor opposing the buoyancy force of an associated module as well as lateral forces exerted on the associated module and load forces directed into the underwater bed.

76. A method for enhancing a load carrying capacity of a structure supported by a plurality of piles having spacing therebetween, the method comprising:

positioning at least one hollow module in the spacing between the piles, each hollow module having a buoyancy force associated therewith;

embedding at least one anchor coupled to the at least one hollow module in an underwater bed, the at least one anchor opposing the buoyancy force of the at least one hollow module and load forces directed into the underwater bed; and wherein the at least one hollow module is in contact with an underside of the structure, the buoyancy force associated with the at least one hollow module thereby enhancing the load carrying capacity of the structure.

77. A method for enhancing a load carrying capacity of a structure supported by a plurality of piles having spacing therebetween, the method comprising:

positioning at least one hollow module in the spacing between the piles, each hollow module having a buoyancy force associated therewith, and each hollow module being at least partially ballasted; and removing ballast from each hollow module such that each hollow module comes into contact with an underside of the structure, the buoyancy force associated with each hollow module thereby enhancing the load carrying capacity of the structure.

78. The method of claim 77 wherein the structure comprises a dock, the at least one hollow module providing support for a portion of a deck of the dock.

* * * * *